United States Patent [19]

Frielinghaus

[11] Patent Number: 4,886,226

[45] Date of Patent: Dec. 12, 1989

[54] BROKEN RAIL AND/OR BROKEN RAIL JOINT BAR DETECTION

[75] Inventor: Klaus H. Frielinghaus, Rochester, N.Y.

[73] Assignee: General Signal Corporation, Stamford, Conn.

[21] Appl. No.: 211,524

[22] Filed: Jun. 23, 1988

[51] Int. Cl.[4] ..... B61L 23/04; B64B 1/06

[52] U.S. Cl. ..... 246/121; 246/28 R; 246/34 R

[58] Field of Search ..... 246/28 C, 28 F, 281 T, 246/34 C, 34 CT, 34 R, 37, 41, 87, 114 R, 120, 121, 125, 130

[56] References Cited

U.S. PATENT DOCUMENTS

| | | | |
|---|---|---|---|
| 2,884,516 | 4/1959 | Staples | 246/34 R |
| 2,975,272 | 3/1961 | Renick et al. | 246/34 R |
| 3,042,799 | 7/1962 | Judge | 246/34 R |
| 3,696,243 | 10/1972 | Risely | 246/121 |
| 3,927,851 | 12/1975 | Wilcox | 246/34 R |
| 3,974,991 | 8/1976 | Geiger | 246/34 CT X |
| 4,108,405 | 8/1978 | Gibson | 246/125 |
| 4,145,018 | 3/1979 | Poggio et al. | 246/34 R |
| 4,298,179 | 11/1981 | Gilcher | 246/34 R |
| 4,306,694 | 12/1981 | Kuhn | 246/28 C X |
| 4,365,777 | 12/1982 | Geiger | 246/125 X |
| 4,369,942 | 1/1983 | Wilson | 246/34 R X |
| 4,622,522 | 11/1986 | Alt | 246/28 K |
| 4,728,063 | 3/1983 | Petit et al. | 246/34 R |

*Primary Examiner*—Andres Kashnikow
*Assistant Examiner*—Timothy Newholm
*Attorney, Agent, or Firm*—R. Reichman; M. LuKacher

[57] ABSTRACT

The apparatus of this invention is a broken rail detection system that detects rail and/or rail breaks in dark territory track sections, i.e. track sections that do not have signalling systems. In one embodiment of this invention a system is disclosed in which a communications link exists between the ends of the track sections and in another embodiment of this invention no communications link exists between the ends of the track sections.

44 Claims, 10 Drawing Sheets

WITH COMMUNICATION LINK

NO COMMUNICATION LINK

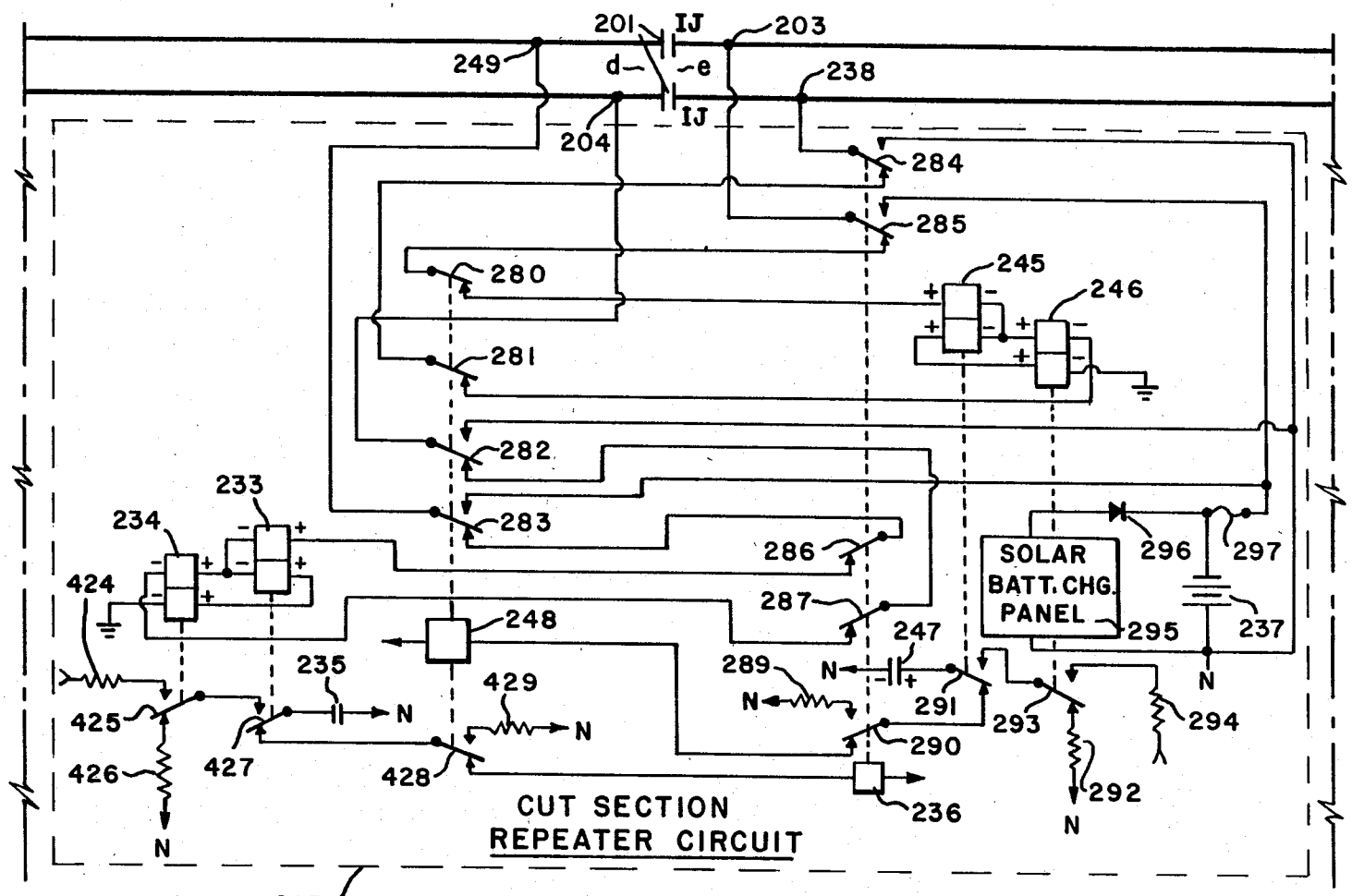
SOLAR
BATT. CHG.
PANEL
CUT SECTION
REPEATER CIRCUIT
IJ
IJ
e
d
N
N
N

BROKEN RAIL AND/OR BROKEN RAIL JOINT BAR DETECTION

BACKGROUND OF INVENTION

This invention relates to electronic devices and more particularly to electronic devices that are used to detect rail and/or rail joint bar breaks.

DESCRIPTION OF THE PRIOR ART

A railway track consists of steel rails which are laid on cross ties. The rails which are usually separated from the ties by steel tie plates are held in position in the case of wooden ties by hook headed spikes that are driven into the ladder through holes in the plates. The ties are embedded in a material called ballast, usually broken stone. The ballast spreads the load of the train over the earth, holds the track in position and acts as a drainage system.

Rails may fatigue and break and/or joint bars may fatigue and break. When a rail and/or joint bar breaks a potentially dangerous condition exists, i.e., the broken rail and/or rail joint may cause a train derailment which may cause human injury and/or property damage.

The prior art employed railroad signalling systems that utilize track circuits as an occupancy detector, i.e., to detect the presence of trains in sections of track and to determine if the rail ends or joint bars were broken. A problem of the foregoing is that prior art signalling systems were designed so that the impedance of the system's feed and the system's sensing device (which may be a relay or receiver) was designed to give its best operation for detecting train occupancy, not rail and/or joint bar breaks. Thus, prior art signalling systems were not optimized to detect all rail and/or joint bar breaks. Typically, railroad signalling systems were installed in sections of track that had moderate to high traffic. It was not economically feasible to install signalling equipment on those sections of track that had relatively low traffic. Thus, low traffic track sections were not controlled by a railroad signalling system that used track circuits and signalling lights to prevent head-on collisions. The sections of track that did not have railroad signalling equipment were called dark territory.

When a train travels in dark territory, the train operates on written train orders and the train dispatcher supposedly is making sure that there is only one train in a line section (which may be forty to fifty miles long) at a time. The dispatcher does not know exactly where the train is but he usually has reserved that section of track for that train and the engineer has a written train order that states that his train is the only train that should be in that particular track section. The engineer is not required to look out for the other train, the train dispatcher is. The aforementioned arrangement is a check-in, check-out system. The dispatcher checks a train in, and the dispatcher will not let another train use that section of track until the original train checks out of the section of track. One of the problems of the foregoing arrangement is that there is not an automatic way to check if there are any rail and/or joint bar breaks. The method currently employed to check for rail and/or joint bar breaks is to have maintenance workers visually inspect the rails and/or joint bars and determine if there are any breaks. One of the problems of the foregoing arrangement is that the rail break and/or joint bar break may occur between visual inspections. Another problem with the aforementioned arrangement is that the time between visual inspections is increasing as some railroads are reducing their operating cost by spending less money on track maintenance. Thus, when a train is travelling through dark territory, the train will travel at a relatively slow speed to permit the engineer to look for rail breaks and stop the train before the train reaches a rail break or to minimize derailments or damage of a derailment if a rail break was not detected. Hence, by reducing the trains speed the transit time of the trip is increased.

A radio-based railway signalling and traffic control system is currently being developed and expected to be brought to market. The aforementioned system utilizes a communications link (which may be terrestrial radio signals or satellite signals) and position locating systems instead of track circuits to perform railroad signalling. The above system is described in John H. Auer, Jr.'s and William A. Pettit Jr.'s U.S. Pat. No. 4,711,418 issued Dec. 8, 1987. If the aforementioned system is used by the railroads, track circuits will not be used and broken rail and/or broken rail joints will not be automatically detected.

However, the invention described in U.S. Pat. No. 4,711,418 entitled "Radio-Based Railway Signalling And Traffic Control System" may be used with the above-referenced radio-based railway signalling and traffic control system to provide broken rail and/or broken rail joint detection. The aforementioned patent application utilizes audio frequency track circuits and a DC feed in the rails as a source of power to provide broken rail and/or broken rail joint detection in track circuits approximately one mile long. Since the distance between railroad sidings may be twenty-five miles or longer, twenty-five or more audio track circuits might have to be used between sidings. Thus, the above system may be relatively expensive, and require considerable power.

SUMMARY OF THE INVENTION

This invention overcomes the problems of the prior art by providing an economical system that detects broken rail and/or broken rail joints by using very low source and receive impedances to optimize broken rail and/or broken rail joint detection. The apparatus of this invention may detect broken rails and/or broken rail joints in single ten mile track sections, where the minimum ballast resistance of the track is 5 ohms per thousand feet or up to five mile track sections when the minimum ballast resistance is 2 ohms per thousand feet. Individual ten mile track sections may be tied together with repeater sections (that do not communicate with the siding ends) between siding ends to cover dark territory sections that may be twenty-five miles or longer. Thus, the apparatus of this invention may be used to detect rail and/or rail joint breaks between railroad passing sidings.

The above invention only uses power for the short time that this invention is activated to make a rail break and/or break joint check just before a train is about to enter the section of track between sidings and/or just after a train has left the track section between sidings. Thus, primary batteries or solar charged secondary batteries may be located with the repeater sections and used to power the apparatus of this invention. Hence, this invention uses substantially less power and fewer repeater sections that the prior art systems. Thus, this invention requires less maintenance of fewer primary batteries or this invention may use small inexpensive solar charging panels to keep its secondary batteries charged, thus, requiring no commercial power.

It is an object of this invention to provide a new and improved device for detecting broken rails and broken rail joints.

It is another object of this invention to provide a new and improved system for detecting rail and/or rail joint breaks in long track sections.

It is a further object of this invention to provide a new and improved system that communicates the non-existence of a rail break and/or rail joint break to either siding end, without line wires, cables or radio link.

Other objects and advantages of this invention will become apparent as the following description proceeds, which description should be considered together with the accompanying drawings.

BRIEF DESCRIPTION OF THE DRAWINGS

FIGS. 7A–7C are schematic diagrams of the apparatus of this invention being used to detect broken rails and/or broken rail joints when the West Siding End and the East Siding End is in unsignalled territory and no communications link exist between the West Siding End and the East Siding End.

FIGS. 7A–7C are assembled to form a complete drawing.

DESCRIPTION OF A PREFERRED EMBODIMENT

Figure 1:
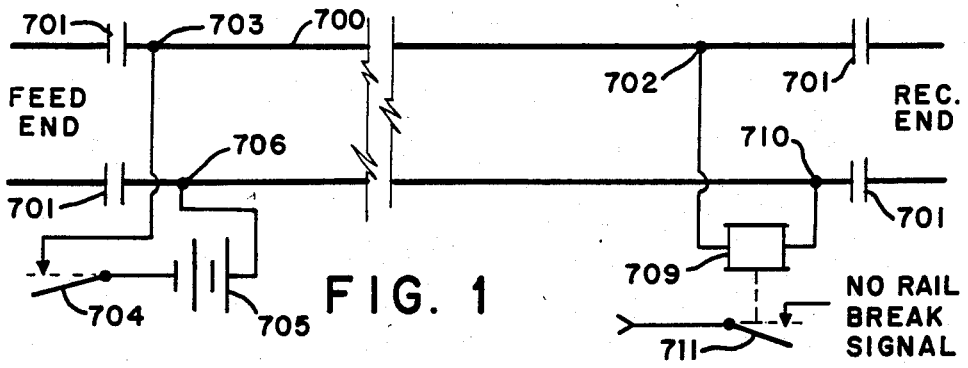
FIG. 1 is a diagram that illustrates the factors which establish the maximum length of a broken rail detection track circuit.

In order to more easily comprehend the principals of this invention, the factors which establish the maximum track section length of a broken rail detection track circuit are illustrated in FIG. 1. Character 700 represents a track having insulating joints 701. Front contact 704 is connected to track 700 at point 703. The heel of contact 704 is coupled to one of the two terminals of battery 705 and the other terminal of battery 705 is coupled to track 700 at point 706. One terminal of relay 709 is connected to track 700 at point 702. The other terminal of relay 709 is coupled to track 700 at point 710. Contact 711 is coupled to relay 709.

The maximum length of a broken rail track circuit is when the track signal at the receive end of track 700, with no rail break at the lowest operating ballast resistance equals the highest signal level at the receive end of track 700 at some intermediate ballast resistance with a rail break in the center of the track section. As the length of track 700 is increased, i.e., the distance between the feed end and receive end of track 700 becomes greater, the above limitation is reached, thus dictating the maximum broken rail detection track circuit length. Hence, if one wanted to optimize the circuit shown in FIG. 1 to give the maximum performance for detecting broken rails for the longest length of track 700, the source resistance (704 and 705) and the resistance of relay 709 would be made as low as practical, i.e., 0.07 ohms or less. The length of track 700 would now be three or four times the length of a typical train occupancy detection track circuit.

If relay 709 at the receive end of track 700 is centered tapped to earth ground, there is a drastic difference in the current flow at the receive end of track 700 when there exists a rail break in track 700 than when a rail break does not exist in track 700. The reason for the foregoing is that current flows through the center tap to earth ground only when there is a rail break. Thus, be sensing both the receive end of track 700 rail-to-rail signal level and the center tap earth ground current, it is possible to extend the maximum track circuit section length for detecting broken rails approximately an additional 20%. The above is illustrated in FIG. 2.

One relay, i.e., relay 709 is used in geographic locations where the earth ground resistance is high. In locations where earth ground resistance is low either relay 709 will be used by itself or relays 712 and 713 as shown in FIG. 2 will be used.

Figure 2:
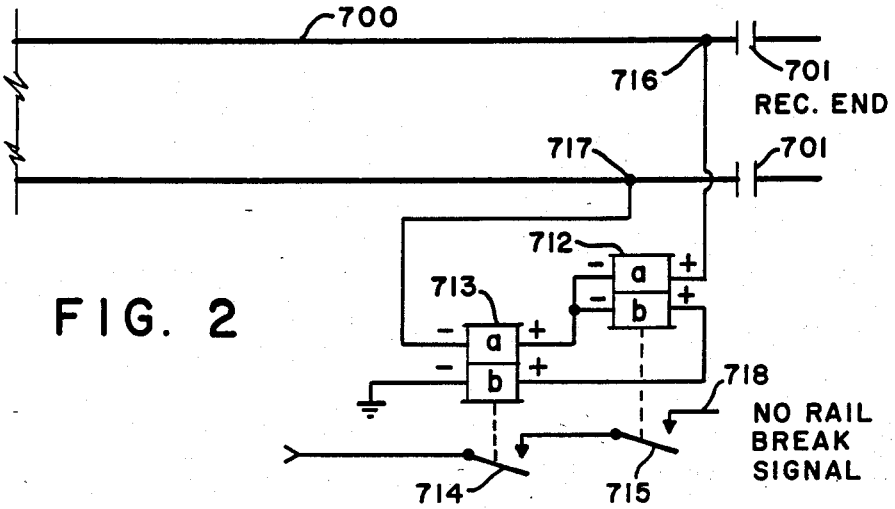
FIG. 2 is a diagram that shows the receive end of the circuit shown in FIG. 1 being center tapped to earth ground.

In FIG. 2, relay 709 and contact 711 from FIG. 1 have been replaced with relays 712 and 713 and contacts 714 and 715. Track 700 and insulating joints 701 still appear in the circuit, and the feed end of the circuit shown in FIG. 2 is the same as the feed end of the circuit shown in FIG. 1.

The positive terminal of coil a of relay 712 is coupled to track 700 at point 716 and the negative terminal of coil a of relay 713 is coupled to track 700 at point 717. The positive terminal of coil a of relay 713 is coupled to the negative terminals of coils a and b of relay 712, and the positive terminal of coil b of relay 712 is coupled to the positive terminal of coil b of relay 713. The negative terminal of coil b of relay 713 is coupled to earth ground. Relay 713 is coupled to contact 714 and relay 712 is coupled to contact 715. Contact 715 is coupled to line 718. The heel of contact 714 is coupled to a positive energy source (not shown) and the front contact of contact 714 is connected to the heel of contact 715.

When there is no rail break in track 700, the current is flowing: from the track 700 to point 716 through the a coil of relay 712; through the a coil of relay 713 to point 717; and returns to track 700 at point 717. Contacts 714 and 715 will be closed and a no rail break signal will be transmitted on line 718. No ground current will be present, since track 700 is balanced. Hence, there will be no current flowing through the b coils of relays 712 and 713, and the portion of the circuit just described will sense the rail-to-rail signal level of track 700.

If track 700 has a rail break to the left of point 716, current will flow through earth ground, through the b coil of relay 713, through the b coil of relay 712 and through the a coil of relay 713. When the rail break takes place on track 700 to the left of point 716, relay 713 will be down, and relay 712 may be up, contact 714 will be open and the no rail break signal will not be transmitted on line 718. However, if the rail break takes place on track 700 to the left of point 717, relay 713 may be up and relay 712 will be down, contact 715 will be open and the no rail break signal will not be transmitted on line 718. Thus, the portion of the circuit just described, factors in the center tap unbalance ground current that results when there is a rail break.

Figure 3:
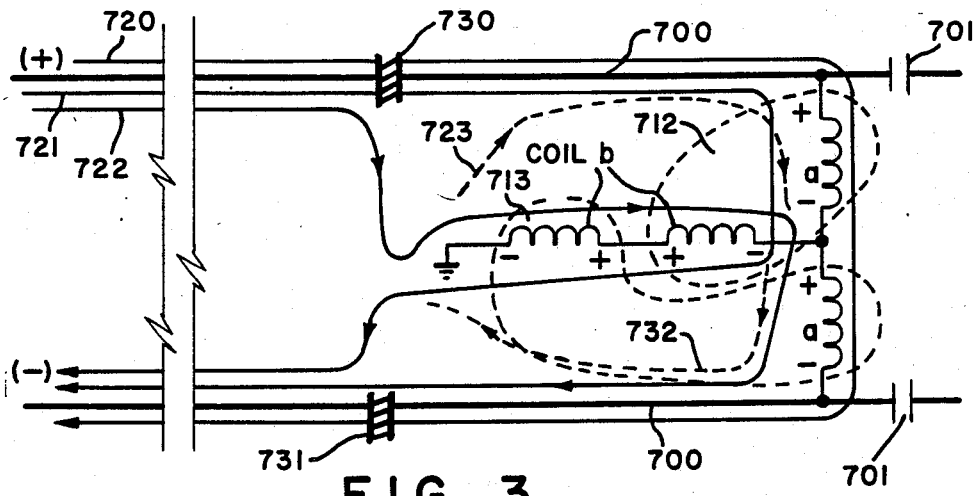
FIG. 3 is a functional circuit diagram illustrating the current flows of the circuit shown in FIG. 2.

FIG. 3 is a functional detail circuit of FIG. 2 illustrating predominant current flows under different rail conditions. When there is no rail break in track 700, the current flows in the direction shown by line 720, i.e., through the upper rail of track 700, down through coil a of relay 712, through relay a of coil 713 and then through the lower rail of track 700. Relays 712 and 713 will be picked up, and no current will flow through coil b of relay 712 and coil b of relay 713.

When there is a rail break in the upper rail of track 700, at point 730, the current flows in the direction shown by line 722, i.e., the current tends to flow in the upper rail of track 700 and down through earth ground in the vicinity of the rail breaks; then through coil b of relay 713; and then through coil b of relay 712. Part of the aforementioned upper rail current will flow in the direction indicated by line 723, i.e., it will return to the upper rail of track 700 after the rail break and will flow through coil a of relay 712 and coil a of relay 713. In the worst case of the above condition, the the relay polarity sense may cause relay 712 to be picked up, while relay 713 will be down because of the bucking effect that the currents have in the coils of relay 713.

When there is a rail break in the lower rail of track 700 at point 731, the current flows in the direction shown by line 721, i.e., the current tends to flow in the upper rail of track 700 and down through coil a of relay 712, through coil b of relay 712, through relay b of coil 713 and down through earth ground in the vicinity of the rail break. Part of the aforementioned lower rail current will flow in the direction indicated by line 732, i.e., it will flow along the lower rail of track 700. Hence, relays 712 and 713 are only both picked up when there are no rail breaks in the illustrated section of track 700.

Figure 4:
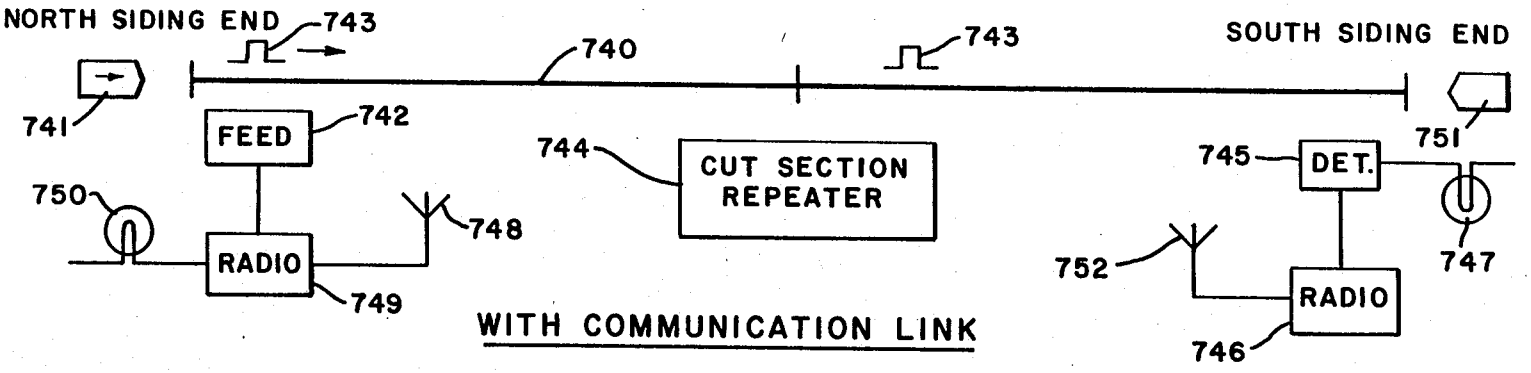
FIG. 4 is a block diagram that illustrates a communication link between the ends of a section of track.

FIG. 4 is a block diagram that illustrates the operation of a communication link between the North Siding End and the South Siding End of a section of track 740. The communications link may be radio, telephone lines, satellite signals, etc. For purposes of this description, only a radio link is going to be described, since the links function in the same manner. The North Siding End communications equipment consists of feed 742, radio 749, antenna 748 and light 750 and the South Siding End communications equipment consists of detector 745, radio 746, antenna 752 and light 747. The first case will illustrate train 741 travelling from the North Siding End to the South Siding End. Train 741 at the North Siding End of track 740 initiates feed 742 causing signal 743 to be propagated along track 740. Cut section repeater 744 will reproduce signal 743 and transmit the aforementioned signal towards the South Siding End of track 740. At the South Siding End, detector 745 will detect reproduced signal 743. Detector 745 will send the above signal to radio 746. Radio 746 will transmit this signal through antenna 752. The signal transmitted by radio 746 will be received by antenna 748 and then radio 749 will process the above signal causing light 750 to be illuminated in green.

The second case will illustrate train 751 travelling from the South Siding End to the North Siding End. Detector 745 will detect the presence of train 751 and cause radio 746 to transmit a signal. The above signal will be received by antenna 748, processed by radio 749 and feed 742. Feed 742 will cause signal 743 to be propagated along track 740. Cut section repeater 744 will reproduce signal 743 and transmit this signal towards the South Siding End of track 740. At the South Siding End detector 745 will detect reproduced signal 743 and cause light 747 to be illuminated in green.

If a rail break is present on track 740, signal 743 would not be able to go from the North Siding End to the South Siding End, consequently neither light 750 nor light 747 will have a green illuminator.

Figure 5:
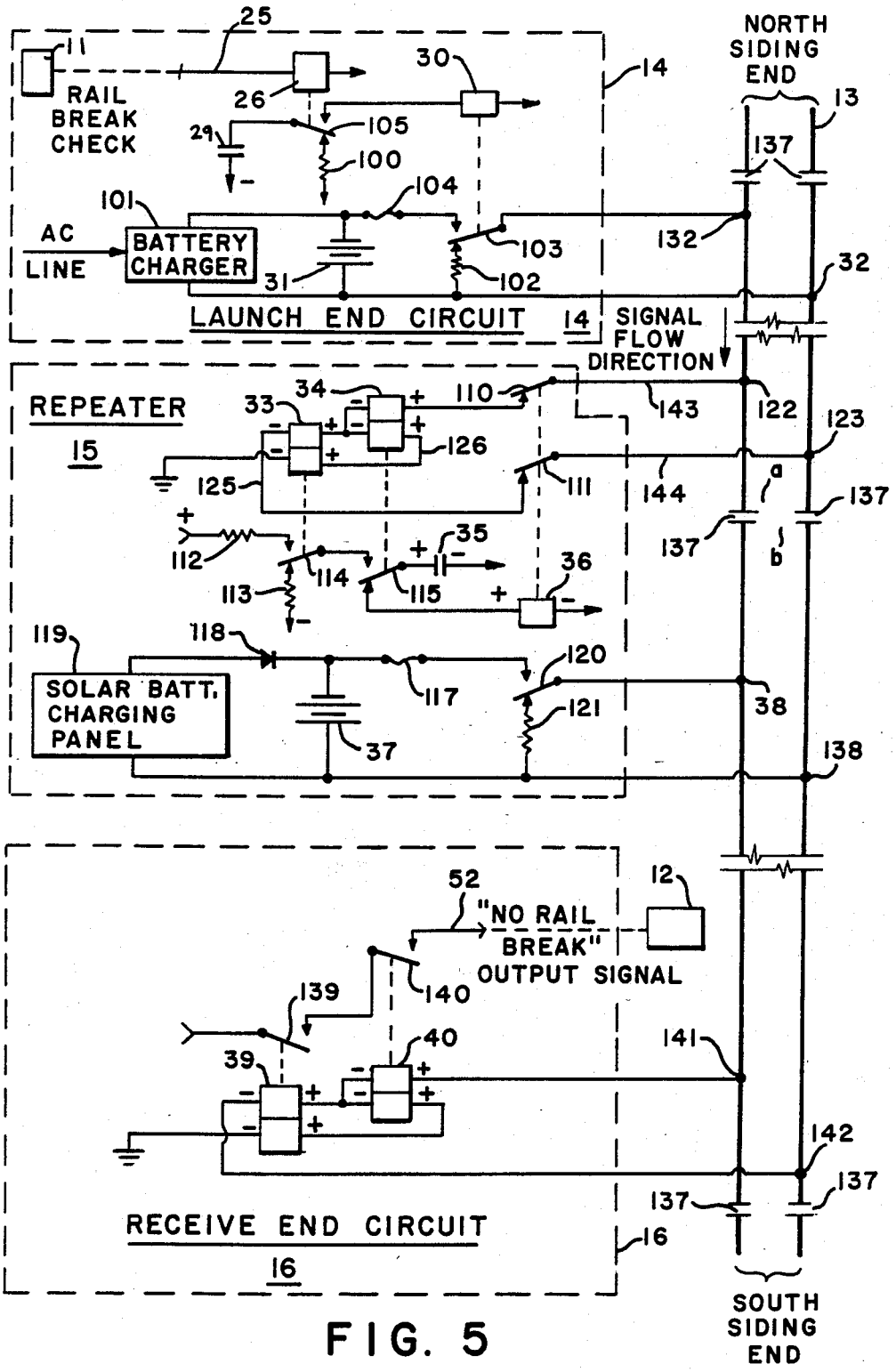
FIG. 5 is a schematic diagram of the apparatus of this invention being used to detect broken rails and/or broken rail joints when a communications link exists between the North Siding End and the South Siding End of a section of track.

FIG. 5 is a schematic diagram that utilizes the communications link shown in FIG. 4. Communication link equipment 11 is located at the North Siding End of track 13. Communication link equipment 12 is located at the South Siding End of track 13. Railway track 13 is shown for convenience as only having two sections, a and b. Track 13 has insulating joints 137. Launch end circuit 14, (the track section having the North Siding End), is coupled to section a, and receive end circuit 16 is coupled to section b, the track section having the South Siding End. Repeater circuit 15 couples sections a and b. The rails of track 13 are continuous and sections a and b may each be up to ten miles long. It will be appreciated that if the distance between North Siding End and South Siding End of track 13 is greater than 20 miles, additional track sections, each up to ten miles long, may be connected between sections a and b. Thus, additional repeater circuits 15 may be connected between sections a and b.

Launch end circuit 14 comprise: Line 25; relay 26; FD feed relay 30; capacitor 29; resistor 100; relay contact 105; battery charger 101; battery 31; resistor 102; relay contact 103; and fuse 104. Line 25 is coupled to relay 26 and relay 26 is coupled to relay contact 105. Contact 105 may be set to its front contact or its back contact. Back contact 105 is coupled to one end of resistor 100 and the other end of resistor 100 is coupled to a positive energy source. Front contact 105 is coupled to the input of relay 30 and the output of relay 30 is coupled to a negative energy source. The heel of contact 105 is coupled to the positive end of capacitor 29 and the negative side of capacitor 29 is coupled to a negative energy source. Battery charger 101 receives power from an AC line. One of the two ports of battery charger 101 is coupled to one end of fuse 104 and one of the terminals of battery 31. The other port of charger 101 is coupled to one of the terminals of battery 31; one end of resistor 102 and track 13 at point 32. The other end of resistor 102 is coupled to back contact 103. Front contact 103 is coupled to one of the ends of fuse 104. The heel of contact 103 is coupled to track 13 at point 132. Relay 26 is coupled to contact 105, and relay 30 is coupled to contact 103.

Repeater circuit 15 comprises: break check relays 33 and 34; relay contacts 110, 111, 114, 115, and 120; resistors 112, 113 and 121; diode 118; solar battery charger panel 119; fuse 117; capacitor 35; battery 37; lines 125, 126, 143 and 144 and feed relay 36.

One of the two negative terminals of break check relay 33 is connected to back contact 111 via line 125. The heel of contact 111 is connected to track 13 at Point 123 via line 144. The second negative terminal of break check relay 33 is connected to earth ground. Break check relay 33 has two positive terminals. One of the positive terminals of relay 33 is coupled to the two negative terminals of relay 34. The second positive terminal of relay 33 is coupled to one of the two positive terminals of relay 34 via line 126. The second positive terminal of relay 34 is coupled to back contact 110. The heel of contact 110 is coupled to track 13 at point 122 via line 143.

One end of resistor 112 is coupled to a positive energy source and the other end of resistor 112 is coupled to front contact 114. Back contact 114 is connected to one of the ends of resistor 113. The other end of resistor 113 is connected to the negative terminal of capacitor 35 and the negative terminal of battery 37. The heel of contact 114 is connected to front contact 115. Back contact 115 is connected to one of the terminals of relay 36. The heel of contact 115 is coupled to the positive terminal of capacitor 35. The negative terminal of capacitor 35 is coupled to a negative energy source. Relay 33 is coupled to contact 114 and relay 34 is coupled to contact 115. Relay 36 is coupled to contacts 110, 111 and 120. One of the terminals of solar battery charge panel 119 is coupled to: one of the terminals of battery 37; one of the ends of resistor 121; and track 13 at point 138. The other terminal of battery charge panel 119 is coupled to diode 118. Diode 118 is also coupled to one of the terminals of battery 37 and one of the ends of fuse 117. The other end of fuse 117 is coupled to front contact 120. Back contact 120 is connected to one of the ends of resistor 121. The heel of contact 120 is coupled to track 13 at point 38.

Receive end circuit 16 comprises: contacts 139 and 140 and break check relays 39 and 40 and line 52. One end of contact 139 is coupled to positive energy source. Front contact 139 is coupled to the heel of contact 140 and front contact 140 is coupled to line 52 which transmits the "no rail break" output signal. One of the two negative terminals of relay 39 is connected to track 13 at Point 142 and the second negative terminal of relay 39 is connected to earth ground. One of the two positive terminals of relay 39 is connected to the two negative terminals of relay 40 and the second positive terminal of relay 39 is connected to one of the two positive terminals of relay 40. The second positive terminal of relay 40 is connected to track 13 at Point 141.

The broken rail detection system shown in FIG. 5 is a single signal direction flow system. When a South bound train (not shown) traveling on track 13 reaches the North Siding End launch end circuit 14 will be utilized to inititate a rail break and/or break joint check. A rail break check will be initiated by energizing line 25 and line 25 will pick up relay 26. If on the other hand, the aforementioned train had been at the South Siding End, traveling north, a command would have been sent from the South Siding End to the North Siding End over the communications link equipment 11 and 12 (the manner in which communication link equipment 11 and 12 functions is described in the description of FIG. 4 and a specific communication link is described in U.S. Pat. No. 4,711,418 entitled "Radio-Based Railway Signalling and Traffic Control System") to utilize launch end circuit 14 to initiate a rail break and/or break joint check. The initiation of a rail and/or break joint check will energize line 25 and pick up relay 26. The picking up of relay 26 would cause the heel of contact 105 to move from back contact 105 to front contact 105. The foregoing would cause charged capacitor 29 to pick up FD feed relay 30. The charge on capacitor 29 would hold up FD relay 30 for about one second and in turn relay 30 would connect battery 31 to track 13 at points 32 and 132, by causing the heel of contact 103 to move from back contact 103 to front contact 103. This will cause a one second long current pulse to be generated on track 13. This current pulse would travel Southward down track 13 and at point 122 would travel through wire 143 and contact 110 to utilize cut repeater section 15 and to pick up break check relays 33 and 34, if there was no rail break between the North Siding End and the track points 122 and 123. The aforementioned current pulse would continue to travel via break check relay 33, wire 125, contact 111, wire 144 and return to track 13 at point 123. If there were no rail and/or break joint breaks between the North Siding End points and points 122 and 123, the picking up of relays 33 and 34 will cause the heel of contact 114 to move from back contact 114 to front contact 114 and the heel of contact 115 to move from back contact 115 to front contact 115 causing capacitor 35 to be charged. When relays 33 and 34 drop out again at the end of the one second current pulse, the heel of contact 114 will move to back contact 114 and the heel of contact 115 will move to back contact 115 so that the charge on capacitor 35 may travel through the heel of contact 115 and pick up FD feed relay 36. The charge on capacitor 35 holds up FD feed relay 36 for about one second and in turn relay 36 connects battery 37 to track 13 at points 38 and 138 by causing the heel of contact 120 to move from back contact 120 to front contact 120. Thus, battery 37 regenerates the one second current pulse in track 13. This current pulse would continue to travel Southward down track 13 (any number of cut section repeaters 15 may be used to cover the total dark territory track length between the North and South Siding Ends), or in this case to receive end circuit 16 at the South Siding End. If there were no rail breaks in track 13 up to points 141 and 142 the track current pulse would pick up break check relays 40 and 39. With both break check relays 39 and 40 up, a "no rail break signal" is generated on line 52. If the train had entered the track section from the North Siding End this no rail break condition would have been sent to the North Siding End over communications link equipment 11 and 12. Equipment 11 would display a signal which will be displayed to the train engineer. If the train had been a northbound train located at the South Siding End the "no rail break" condition would be displayed to the train engineer by communication link equipment 12, located at the South Siding End.

In the event track 13 had a rail break, an appropriate "no rail break signal" would not be transmitted to the appropriate North Siding End or South Siding End, dependent upon whether or not the train was a northbound or southbound train.

Figure 6:
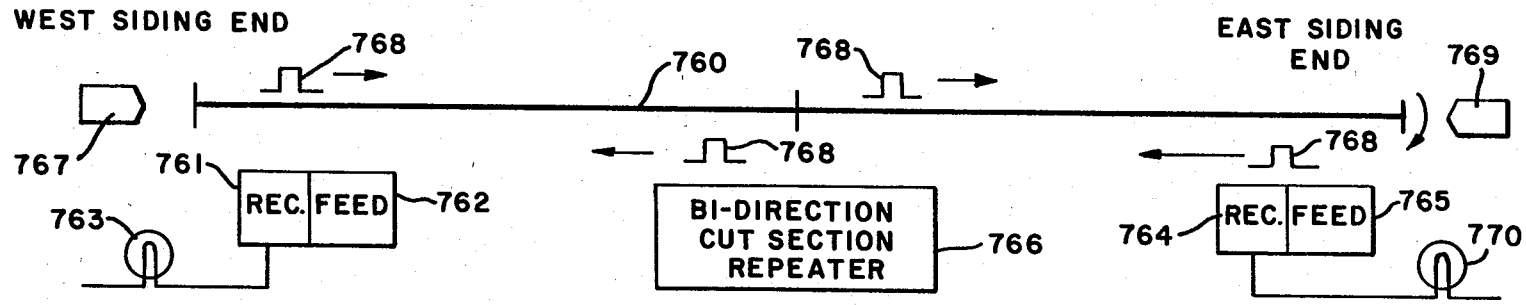
FIG. 6 is a block diagram that illustrates the manner in which communications may be performed between the ends of a section of track when no communication link exists between the ends of the section of track.

FIG. 6 is a simplified block diagram that illustrates the manner in which communication may be performed between a West Siding End and a East Siding End of a section of track 760 when no communication link exists between the West Siding End and East Siding End. Receive equipment 761, feed equipment 762 and light 763 are located at the West Siding End. Receive equipment 764, feed equipment 765 and light 770 are located at the East Siding End. Bi-directional cut section repeater 766 is located near the center of track section 740.

When train 767 is traveling from the West Siding End of track 760 to the East Siding End, train 767 initiates feed 762 which causes signal 768 to be propagated along track 760. Bi-direction cut section repeater 766 will reproduce signal 768 and transmit the aforementioned signal towards the East Siding End of track 760. Receiver 764 will receive the above signal and re-transmit the aforementioned signal along track 768 to repeater 766. Repeater 766 will reproduce signal 768 and transmit the signal to receiver 761. Receiver 761 will cause light 763 to have a green illumination.

When train 769 is traveling from the East Siding End of track 760 to the West Siding End, train 769 initiates feed 764 which causes signal 768 to be propagated along track 760. Bi-direction cut section repeater 766 will reproduce signal 768 and transmit the aforementioned signal towards the West Siding End of track 760. Receiver 761 will receive the above signal and re-transmit the aforementioned signal 768 along track 760 to repeater 766. Repeater 766 will reproduce signal 768 and transmit the signal to receive 764. Receiver 764 will cause light 770 to have a green illumination.

If a rail break is present on track 760, signal 768 would not be able to travel from the West Siding End to the East Siding End, consequently neither light 763 nor light 770 will have a green illumination.

Figure 7A:
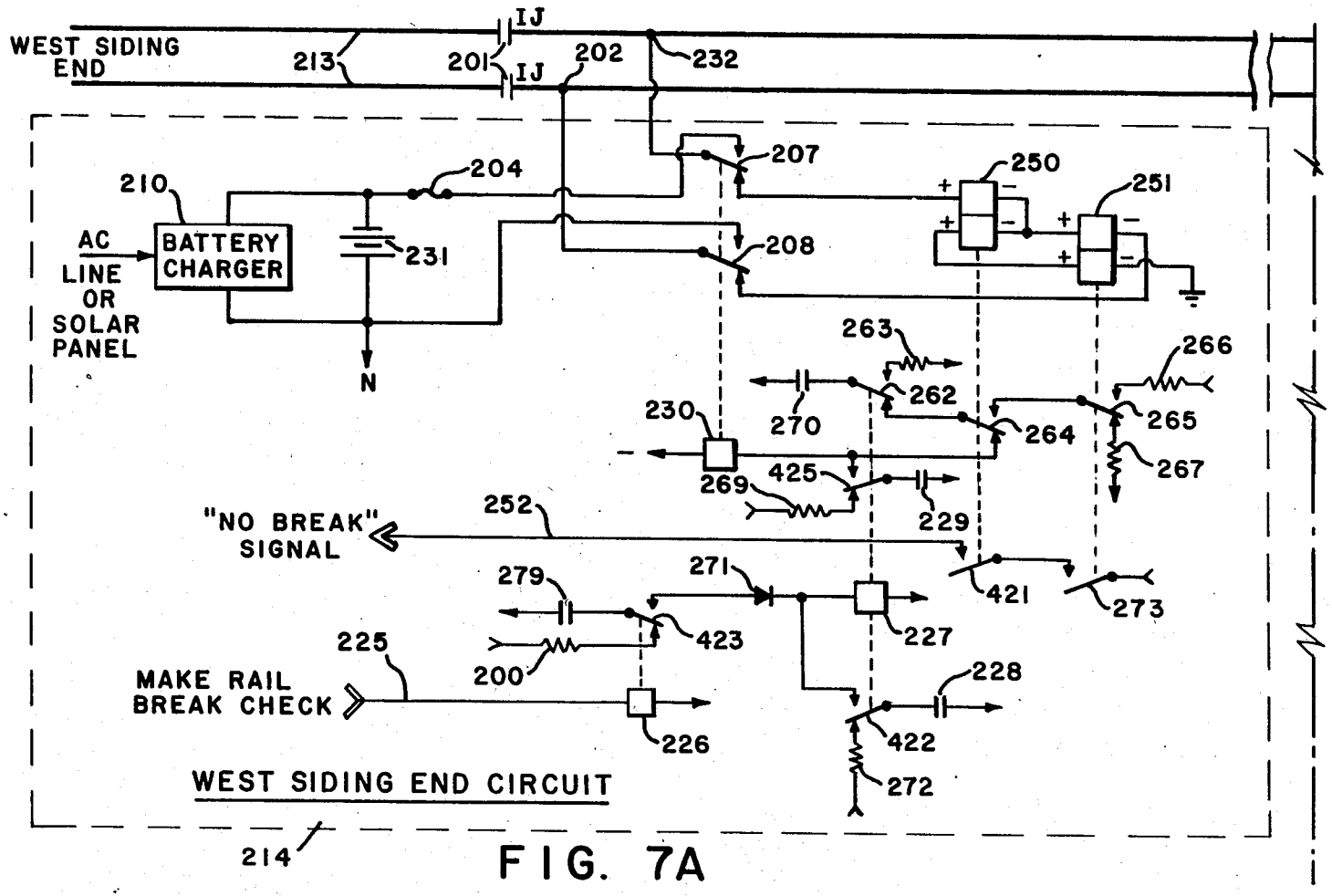
Figure 7C:
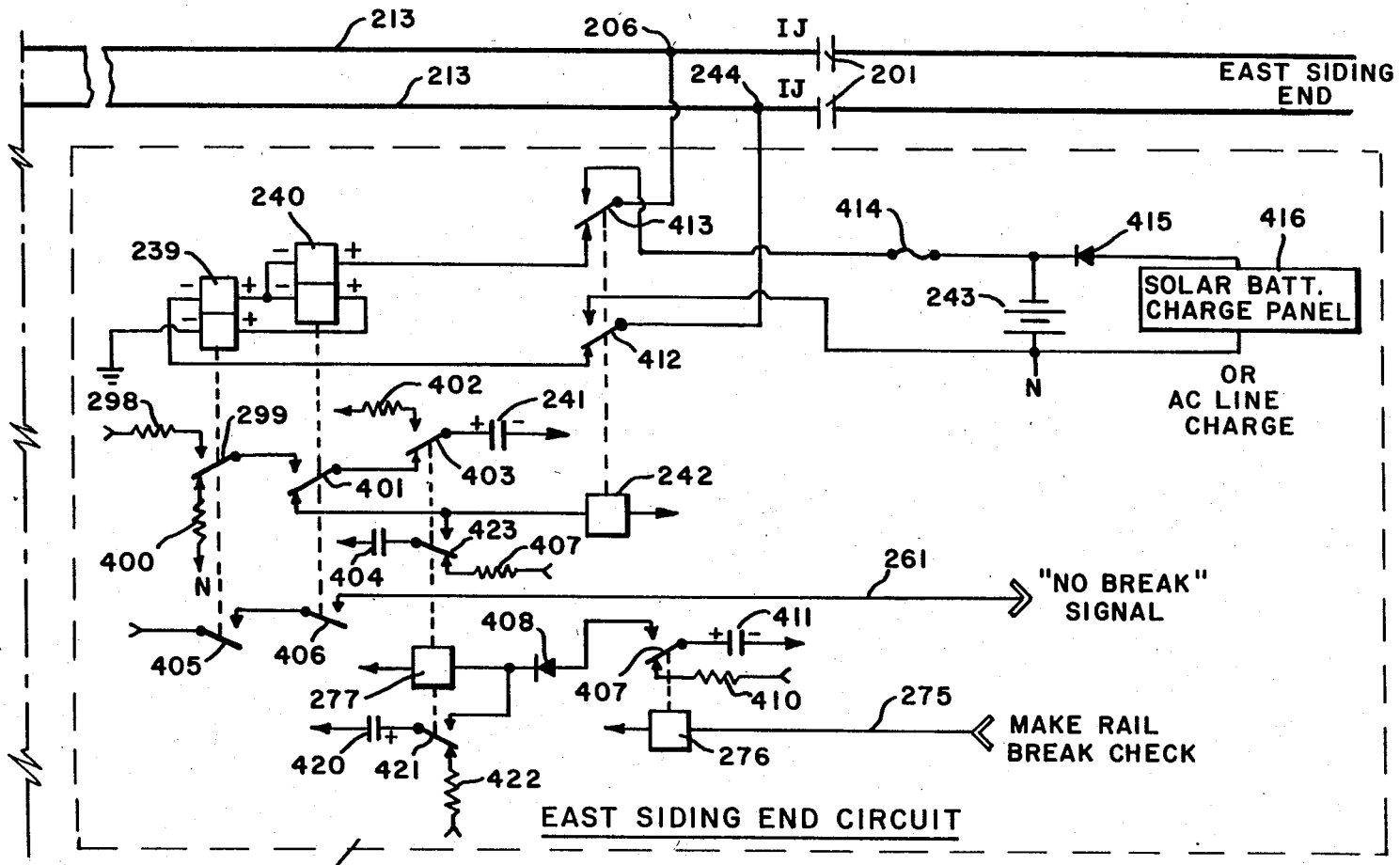

FIGS. 7A through 7D are diagrams with FIG. 2D being a matrix showing the interconnections of FIGS. 7A–7C.

FIGS. 7A–7C are diagrams that illustrate the embodiment of this invention that would be used when the West Siding End FIG. 7A) and East Siding End (FIG. 7C) are in dark territory and no communications link exists between the West and East Siding Ends of railway track 213. Railway track 213 is shown for convenience as only having two sections d and e. Insulating joints 201 are connected to track 213. West Siding End circuit 214 (the track section having the East Siding), is coupled to section d, and East Siding End circuit 216 (the track section having the West Siding End) is coupled to section e. Cut section repeater circuit 215 couples sections d and e. The rails of track 213 are continuous and sections d and e may each be ten miles long. It will be appreciated that if the distance between West Siding End and East Siding End of track 213 is greater than twenty miles additional track sections each up to ten miles long may be connected between sections d and e. Thus, additional repeater circuits 215 (FIG. 7B) may be connected between sections d and e.

West Siding End circuit 214 (FIG. 7A) comprises: line 225; relay 226; FD feed relay 230; diode 271; capacitors 228, 229, 270 and 279; resistor 272; relay contact 442; battery charger 210; battery 231; relays 226, 227, 230, 250 and 251; resistors 272, 200, 266, 269, 267 and 263; relay contacts 207, 208, 262, 264, 265, 273, 421, 422, 425 and 423; line 252 and fuse 204.

Line 225 is coupled to relay 226 and relay 226 is coupled to contact 423 as well as a negative power source. The heel of contact 423 may be set to front contact 423 or back contact 423. Back contact is coupled to one end of resistor 200 and the other end of resistor 200 is coupled to a positive power source. The heel of contact 423 is coupled to one end of capacitor 279 and the other end of capacitor 279 is coupled to a negative power source. Front contact 423 is coupled to one end of diode 271 and the other end of diode 271 is coupled to front contact 422. Back contact 422 is coupled to one of the ends of resistor 272 and the other end of resistor 272 is coupled to a positive power source. The heel of contact 422 is coupled to one of the ends of capacitor 228 and the other end of capacitor 228 is coupled to a negative power source. Diode 271 is also coupled to the input of relay 227. Relay 227 is coupled to contacts 422, 425 and 262. One end of resistor 269 is coupled to back contact 425 and the other end of resistor 269 is coupled to a positive power source. One end of capacitor 229 is coupled to the heel of contact 425 and the other end of capacitor 229 is coupled to a negative power source. Front contact 425 is coupled to one of the terminals of relay 230 and the other terminal of relay 230 is coupled to a negative power source. Front contact 425 is also coupled to back contact 264. Front contact 264 is coupled to the heel of contact 265. Front contact 265 is coupled to one end of resistor 266 and the other end of resistor 266 is coupled to a positive power source. Back contact 265 is coupled to one end of resistor 267 and the other end of resistor 267 is coupled to a negative power source. The heel of contact 264 is coupled to back contact 262 and the heel of contact 262 is coupled to one end of capacitor 270. The other end of capacitor 270 is coupled to a negative power source. Front contact 262 is coupled to one end of resistor 263 and the other end of resistor 263 is coupled to a negative power source. Battery charger 210 receives power from an AC line or solar panel. One of the two outputs of charger 210 is coupled to one of the inputs of battery 231 and one of the ends of fuse 204. The other output of battery charger 219 is coupled to one of the terminals of battery 231 and front contact 208. The other end of fuse 204 is coupled to front contact 207. Back contact 207 is coupled to one of the two positive terminals of relay 250. The second positive terminal of relay 250 is coupled to one of the two positive terminals of relay 251. The two negative terminals of relay 250 are coupled to one of the positive terminals of relay 251. One negative terminal of relay 251 is coupled to earth ground and the other negative terminal of relay 251 is coupled to back contact 208. Relay 230 is coupled to contacts 207 and 208. Relay 250 is coupled to contacts 264 and 421. Relay 251 is coupled to contacts 265 and 273. Line 252 which transmits the "no break signal" is coupled to front contact 421. The heel of contact 421 is coupled to front contact 273, and front contact 273 is coupled to a positive power source. The heel of contact 208 is coupled to track 213 at point 202 and the heel of contact 207 is coupled to track 213 at point 232.

Repeater circuit 215 (FIG. 7B) comprises: relays 233, 234, 236, 245, 246 and 248; contacts 280, 281, 282, 283, 284, 285, 286, 287, 290, 291, 293, 425, 428 and 427; resistors 424, 426, 429, 289, 292, 294; diode 296 solar battery charge panel 295; fuse 297; capacitors 235 and 247 and battery 237.

One end of resistor 424 is coupled to a positive power source and the other end of resistor 424 is coupled to front contact 425. Back contact 425 is coupled to one of the ends of resistor 426 and the other end of resistor 426 is coupled to a negative power source. The heel of contact 425 is coupled to front contact of 427. Back contact 427 is coupled to the heel of contact 428. The heel of contact 427 is also coupled to one of the ends of capacitor 235 and the other end of capacitor 235 is coupled to a negative power source. Front contact 428 is coupled to the one of the ends of resistor 429 and the other end of resistor 429 is coupled to the negative power source. Back contact 428 is coupled to one of the terminals of relay 236. The other terminal of relay 236 is coupled to a negative power source. One of the terminals of relay 248 is coupled to back contact 290. Front contact 290 is coupled to a positive end of resistor 289. The other end of resistor 289 is coupled to a negatitive power source. The heel of contact 290 is coupled to back contact of 291. The heel of contact 291 is coupled to the positive end of capacitor 247 and the negative end of capacitor 247 is coupled to a negative power source. Front contact 291 is coupled to the heel of contact 293. Back contact 293 is coupled to one of the ends of resistor 292 and the other end of resistor 292 is coupled to a negative power source. Front contact 293 is coupled to a positive energy source at one of the ends of resistor 294 and the other end of resistor 294 is coupled to one of the power source. One of the negative terminals of eastbound check relay 234 is coupled to earth ground. The second negative terminal to relay 234 is coupled to back contact 287. The heel of contact 287 is coupled to back contact 282. The heel of contact 282 is coupled to track 213 at point 204. One of the two positive terminals of relay 234 is coupled to the two negative terminals of eastbound check relay 233. The second positive terminal of relay 234 is coupled to one of the two positive terminals of relay 233. The second positive terminal of relay 233 is coupled to back contact 286. The heel of contact 286 is coupled to back contact 283. The heel of contact 283 is connected to track 213 at point 249. Front contact 283 is connected to one of the ends of fuse 297 and front contact 285. Front contact 282 is connected to the negative terminal of battery 237, and front contact 284. Westbound check relay 245 has two positive terminals and two negative terminals. One of the positive terminals of relay 245 is coupled to back contact 280. The second positive terminal of relay 245 is coupled to one of the two positive terminals of westbound check relay 246. The two negative terminals of relay 245 are coupled to the second positive terminal of relay 246. One of the negative terminals of relay 246 is connected to earth ground. The other negative terminal of relay 246 is connected to back contact 281. The heel of contact 281 is connected to back contact switch 284. Solar battery charge panel 295 has two ports. One of the ports of panel 295 is connected to one of the ends of diode 296. The second port of panel 295 is coupled to the negative terminal of battery 237 and to front contact 284 and to front contact 282. The other end of diode 296 is coupled to the position terminal of battery 237 and to one of the ends of fuse 297. The other end of fuse 297 is coupled to front contact 283 and front contact 285. The heel of contact 284 is connected to track 213 at point 238 and the heel of contact 285 is connected to track 213 at point 203. Back contact 284 is connected to the heel of contact 281 and back contact 285 is connected to the heel of contact 280. Back contact 280 is connected to the positive terminal of relay 245. Relay 234 is coupled to contact 425 and relay 233 is coupled to contact 427. Westbound feed relay 248 is coupled to contacts 428, 280, 281, 282 and 283. Eastbound feed relay 236 is coupled to contacts 290, 287, 286, 285 and 284. Relay 245 is coupled to contact 291 and relay 246 is coupled to contact 293.

East siding end circuit 216 (FIG. 7C) comprises: relays 277, 239, 240, 242 and 276; contacts 412, 413, 299, 401, 403, 405, 406, 407, 423 and 421; resistors 298, 400, 402, 422, 410 and 407; solar battery charge panel 416; fuse 414; line 261; line 275; capacitors 404, 420, 411 and 241, diodes 415 and 408 and battery 243.

The negative end of capacitor 420 is coupled to a negative power source and the positive end of capacitor 420 is coupled to the heel of contact 421. Back contact 421 is coupled to one end of resistor 422 and the other end of resistor 422 is coupled to a positive power source. Front contact 421 is coupled to one of the ends of diode 408 and one of the terminals of relay 277. The other terminal of relay 277 is coupled to a negative power source. The other end of diode 408 is coupled to front contact 407. Back contact 407 is coupled to one end of resistor 410 and the other end of resistor 410 is coupled to a positive power source. The heel of contact 407 is coupled to one of the ends of capacitor 411. The other end of capacitor 411 is coupled to a negative power source. One terminal of relay 276 is coupled to a negative power source and the other end of relay 276 is line 275 which carries the: make rail brake check: signal. Relay 276 is also coupled to contact 407. Front contact 405 is coupled to the heel of contact 406 and the heel of contact 405 is coupled to a positive power source. Front contact 406 is coupled to line 261 which transmits the "no-break" signal. One end of capacitor 404 is coupled to a negative power source and the other end of capacitor 404 is coupled to the heel of contact 423. Back contact 423 is coupled to one end of resistor 407 and the other end of resistor 407 is coupled to a positive power source. Front contact 423 is coupled to back contact 401 and one of the ports of relay 242. The other port of relay 242 is coupled to a negative power source. The heel of contact 401 is coupled to back contact 403. The heel of contact 403 is coupled to one of the ends of capacitor 241 and the other end of capacitor 241 is coupled to a negative power source. Front contact 403 is coupled to one of the ends of resistor 402 and the other end of resistor 402 is coupled to a negative power source. Front contact 401 is coupled to the heel of contact 299. Back contact 299 is coupled to one end of resistor 400 and the other end of resistor 400 is coupled to the negative terminal of battery 243. Front contact 299 is coupled to one end of resistor 298 and the other end of resistor 298 is coupled to a positive power source. One of the negative terminals of relay 239 is coupled to earth ground. The second negative terminal of relay 239 is coupled to back contact 412. One of the two positive terminals of relay 239 is coupled to the two negative terminals of relay 240. The second positive terminal of relay 239 is coupled to one of the two positive terminals of relay 240. The second positive terminal of relay 240 is coupled to back contact 413. The heel of contact 412 is coupled to track 213 at point 244. Front contact 412 is coupled to the negative terminal of solar battery charge panel 416 and the battery 243. The other terminal of panel 416 is coupled to one of the ends of diode 415. The other end of diode 415 is coupled to the position terminal of battery 243 and one end of fuse 414. The other end of fuse 414 is coupled to front contact 413. The heel of contact 413 is coupled to track 213 at point 206. Relay 239 is coupled to contacts 299 and 405. Relay 240 is coupled to contacts 401 and 406. Relay 277 is coupled to contacts 421, 423 and 403. Relay 242 is coupled to contacts 412 and 413. Relay 276 is coupled to contact 407.

The broken rail detection scheme shown in FIGS. 7A-7D is utilized when the track section between siding ends is in unsignalled territory and no communications link exist between the siding ends. The detection scheme shown in FIG. 7A-7D is bi-directional and permits the interrogation of a rail break check sequence from either the West or East Siding End. The interrogating rail current signal pulse would then be propagated towards the siding end in which the train is not currently located and at that point the apparatus of this invention would reverse and propagate the rail break check pulse signal back toward the originating siding end in order to provide the train engineer with a track condition signal at the siding end where he is located.

In order to illustrate the foregoing we will assume that a train is at the West Siding End (FIG. 7A) travelling towards the East Siding End (FIG. 7C). A rail break check would be initiated by applying energy to line 255, which would pick up relay 226. Relay 226 causes the heel of contact 423 to move from back contact 423 to front contact 423 causing eastbound check relay 227 to be picked up by the charge on capacitor 279 passing through diode 271. Relay 227 will remain picked up for approximately 30 seconds since charged capacitor 228 has sufficient capacity to hold up relay 227 for approximately 30 seconds. The energizing of Eastbound check relay 227, conditions the apparatus of this invention so that West Siding End circuit 214 (FIG. 7A) is the rail break signal launching and receiving circuit. In the above mode, Westbound check relay 277 which is located at the East Siding End (FIG. 7C), is down, to condition East Siding End circuit 216 to reverse the direction of the rail break check signal when it arrives at the East Siding End. When relay 227 is picked up it in turns picks up east feed relay 230 by causing the heel of contact 425 to move from back contact 425 to front contact 425 so that a pulse may pass from charged capacitor 229 to relay 230. The charge on capacitor 229 will hold up relay 230 for approximately one second. When relay 230 picks up, it connects battery 231 to track 213 at points 202 and 232 (by causing the heel of contact 208 to move from back contact 208 to front contact 208 and the heel of contact 207 to move from back contact 207 to front contact 207). When the foregoing happens a one second long track current pulse will be generated and propagated eastbound down track 213. If there are no rail breaks between West Siding End circuit 214 (FIG. 7A) and cut section repeater circuit 215 (FIG. 7B) the eastbound break check relays 233 and 234 will pick up. With both relays 233 and 234 picked up, the heel of contact 425 will move from back contact 425 to front contact 425 and the heel of contact 427 will move from back contact 427 to front contact 427 causing capacitor 235 to be charged. When both relays 233 and 234 drop away again at the end of the one second long track current pulse, the heel of contact 425 will move from front contact 425 to back contact 425 and the heel of contact 427 will move from front contact 427 to back contact 427 and charged capacitor 235 will pick up the eastbound feed relay 236 through back contact 428 of relay 248. Charged capacitor 235 will pick up relay 236 for a one second period, which in turn connects battery 237 across track 213, at points 203 and 238, by having the heel of contact 284 and contact 285 move from back contacts 284 and 285 to front contacts 284 and 285, creating a regenerated one second track signal pulse on the east side of insulated joints on track 213. The aforementioned pulse continues to be propagated eastward on track 213 toward the next cut section repeater circuit or, as in this example, since there is only one repeater section 215 (FIG. 7B), towards East Siding End circuit 216 (FIG. 7C). If there are no rail breaks in track 213 between cut section repeater circuit 215 and East Siding End circuit 214, the track signal pulse will pick up break check relay 239 and 240 (via point 206, the heel of contact 413, back contact 413) and break check relay 239 (via point 244, the heel of contact 412, back contact 412). At this juncture at the East Siding End, the track signal current pulse reverses itself and is repropagated in the opposite direction so that it is travelling towards the West Siding End. Westbound check relay 277 being down, causes East Siding End circuit 216 to perform in this manner by allowing capacitor 241 to be charged when both relays 239 and 240 are picked up (the heel of contact 299 will move from back contact 299 to front contact 299, the heel of contact 401 will move from back contact 401 to front contact 401 and the heel of contact 403 will remain set at back contact 403). When relays 239 and 240 both drop away, the heel of contact 299 will move from front contact 299 to back contact 299 and the heel of contact 401 will move from front contact 401 to back contact 401. At the end of the one second long track signal current pulse, west feed relay 242 is picked up by charged capacitor 241 (the heel of contact 403 will be at back contact 403 and the heel of contact 401 will be at back contact 401). Relay 242 will be held up about one second by charged capacitor 241, during which time it disconnects relays 239 and 240 from track 213 by causing the heel of contact 413 to move from back contact 413 to front contact 413 and the heel of contact 412 to move from back contact 412 to front contact 412 and connects battery 243 to track 213 at points 206 and 244 to create a regenerated one second track signal pulse. This pulse now travels in a westward direction down track 213 and picks up westbound break check relays 245 and 246 (via point 203 on track 213, the heel of contact 285 is set to back contact 285, the heel of contact 280 is set to back contact 280) and (via point 238 on track 213, the heel of contact 284 is set to back contact 284, heel of contact 281 is set to back contact 281) at cut section repeater circuit 215. When relays 245 and 246 both pick up, they cause capacitor 247 to be charged by causing the heel of contact 291 to move from back contact 291 to front contact 291 and the heel of contact 293 to move from back contact 293 to front contact 293. At the end of the track signal pulse, both relays 245 and 246 will drop out (the heel of contact 290 is set at back contact 290) and charged capacitor 247 will pick up westbound feed relay 248. Thereupon relay 248 will connect battery 237 to track 213 at points 204 and 249 by causing: the heel of contact 283 to move from back contact 283 to front contact 283; the heel of contact 282 to move from back contact 282 to front contact 282. The foregoing regenerates a new track signal pulse. This pulse now travels in a westward direction down track 213 via point 232 to the heel of contact 207 (which is set to back contact 207), through point 202 to the heel of contact 208 is set to back contact 208 and picks up west break check relays 250 and 251. With relays 250 and 251 picked up, the heel of contact 421 will move to front contact 421 and the heel of contact 273 will move to front contact 273 so that relays 250 and 251 will produce a "no rail break signal" which will be transmitted on line 252. The aforementioned signal will be transmitted to West Siding End wayside equipment (not shown) in order to indicate the track condition to the engineer. A track signal pulse reversal will not occur at the West Siding End, since the West Siding End is the signal launching siding end, eastbound check relay 227 was held up for thirty seconds by the charge on capacitors 279 and 228 when the break check was initiated from the West End Siding by the pick up of relay 226. The thirty second picked up period for relay 227 (break check initiated from the West Siding End) or relay 277 (break check initiated from the East Siding End) is longer than the round trip time of the break check pulse traveling through the system. With relay 227 picked up, the heel of contact 262 will move from back contact 262 to front contact 262 and capacitor 270 will be discharged. Thus, when relays 250 and 251 drop away or when relay 227 drops away at the end of its thirty second pick up time, discharged capacitor 270 cannot pick up the east feed relay 230.

The foregoing description has described a west to east train movement, a similar system operation would have occurred for an east to west train movement. In the case of an east to west train movement, westbound check relay 277 would have been picked up for thirty seconds and eastbound check relay 227 would have remained down.

In the embodiment of this invention described in FIG. 5, insulating joints 137 are used in track 13 to isolate one track section from the next and in the embodiment of this invention described in FIG. 7 insulating joints 201 are used in track 213 to isolate one track section from the next. If the insulating quality of insulating joints 137 or 201 deteriorates, it might impose an additional load on one or more of batteries 31, 37, 231, 237 and 243 and reduce the signal level at the next break check relay or if the aforementioned insulating joints had become shorted, it might cause back feed and possibly pick up an upstream break check relay. While the above two actions would not be an unsafe failure, it could make this invention inoperable. Thus, it would be desirable if the quality of the aforementioned insulating joints could be determined in an automatic manner.

Figures 7D, 8:
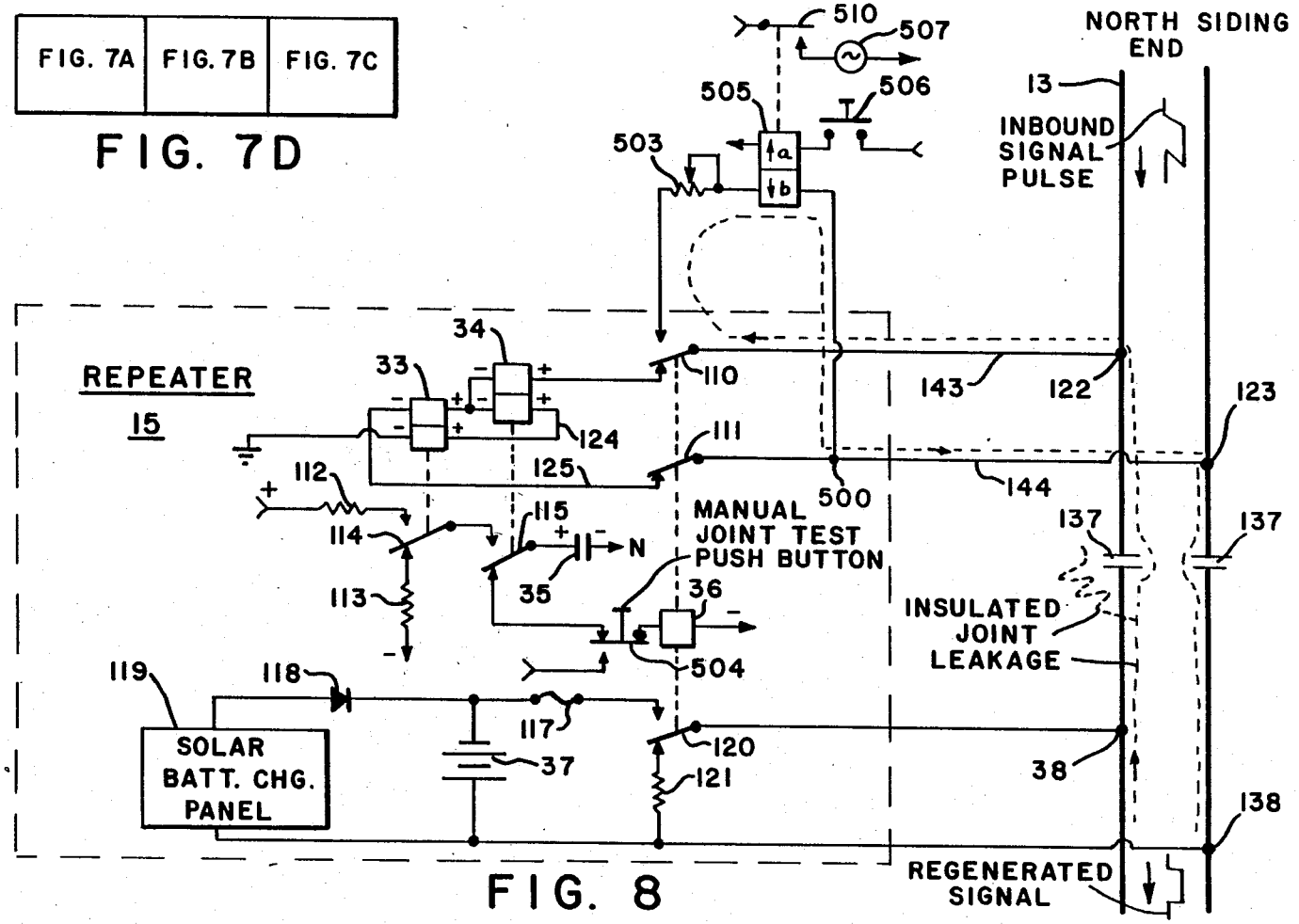
FIG. 7D is a matrix showing how
FIG. 8 is a schematic diagram of a device that may be connected to repeater 315 of FIG. 5 or repeater 215 of FIG. 7B to automatically determine the insulating quality of the insulated joints.

FIG. 8 illustrates a means by which the insulating quality of the aforementioned insulating joints may be determined and indicated. The device shown in FIG. 8 may be connected to repeater 15 of FIG. 5 or repeater section 215 of FIG. 7B. For illustrative purposes the embodiment described in FIG. 8 is shown being coupled to repeater 15 of FIG. 5 at points 500 and 502. Insulating joints 137 are connected to rails 13 and repeater section 15 is connected to rails 13 at points 122, 123, 38 and 138 in the same manner as was shown in the description of FIG. 5. Manual joint test push button 504 is coupled to relay 36 with one terminal, to the back of contact 115 with the second terminal and to a positive power source with the third terminal. Coil a of bi-stable relay 505 is coupled to one of the contacts of reset push button 506 and the other contact of button 506 is coupled to a positive power source. The other terminal of coil a of relay 505 is connected to a negative power source. Coil b of relay 505 is coupled to point 500 on line 144. Coil b of Relay 505 is also coupled to one end of variable resistor 503. The other end of resistor 503 is coupled to front contact 110. Maintainer indicator 507 is coupled to back contact 510 and indicator 507 is also coupled to a negative power source. The heel of contact 510 is coupled to a positive power source. The insulated joint leakage from joints 137 is shown in dotted lines on FIG. 8.

In order to illustrate the operation of repeater section 15 which has broken down insulated joint detection capabilities we will assume that the rail break track signal pulse is travelling down track 13 from north to south. If track 13 has no rail breaks north of points 122 and 123, when the track signal pulse arrives at points 122 and 123 on track 13 the aforementioned signal pulse will pick up break check relays 33 and 34. The picking up of relays 33 and 34 causes capacitor 35 to be charged. At the end of the track signal pulse relays relays 33 and 34 drop out and pick up feed relay 36 through contacts 114 and 115 and charged capacitor 35. When feed relay 36 picks up, it disconnects relays 33 and 34 from track 13 by causing the heel of contact 110 to move from back contact 110 to front contact 110 and the heel of contact 111 to move away from back contact 111 connecting relay 505 to track 13. Bi-stable relay 505 which acts as an insulating joint check relay will now be connected to track 13 at point 123. Point 123 is north of insulating joints 137. Relay 36 also causes the heel of contact 120 to move from back contact 120 to front contact 120 resulting in battery 37 being connected to track 13 at points 38 and 138. Points 38 and 138 are on the south side of insulated joints 137. At this juncture the aforementioned track signal pulse was regenerated and it will travel South down track 13 to the next cut section repeater. If insulated joints 137 have become leaky, when battery 37 is connected across track 13, some current will flow through bad insulating joints 137 and to relay 505 and knock it down. Relay 505 is a bi-stable relay which is initially picked up by the manual action of the reset push button 506. Relay 505 is a bi-stable relay and will stay picked up without power until it is knocked down by a current pulse that is received from track 13 when relay 36 is up. When relay 505 is knocked down by leakage current through insulated joints 137 it will illuminate maintainers indicator 507 or in the case of a bi-stable failure a flag indicator (not shown) will rise. As can be seen from the above, every time a signal pulse is generated, an insulated joint quality check is automatically made. The joint test push button 504 is a manual means for maintenance personnel to make an insulated joint quality test when they are at the location by allowing him to manually pick up relay 36. It will be apparent to one skilled in the art that each break check relay pair i.e., relay pairs 250 and 251, 233 and 234, 245 and 246, and 239 and 240 in FIG. 7 may be replaced by a single relay for each relay pair. One relay for each relay pair will be used when earth ground resistance is high or when maximum track section lengths are not required. For the same reason as above, single relay substitutions may be made for relay pairs 33 and 34 and 39 and 40 in FIG. 5 and relay pairs 33 and 34 in FIG. 8.

Figure 9:
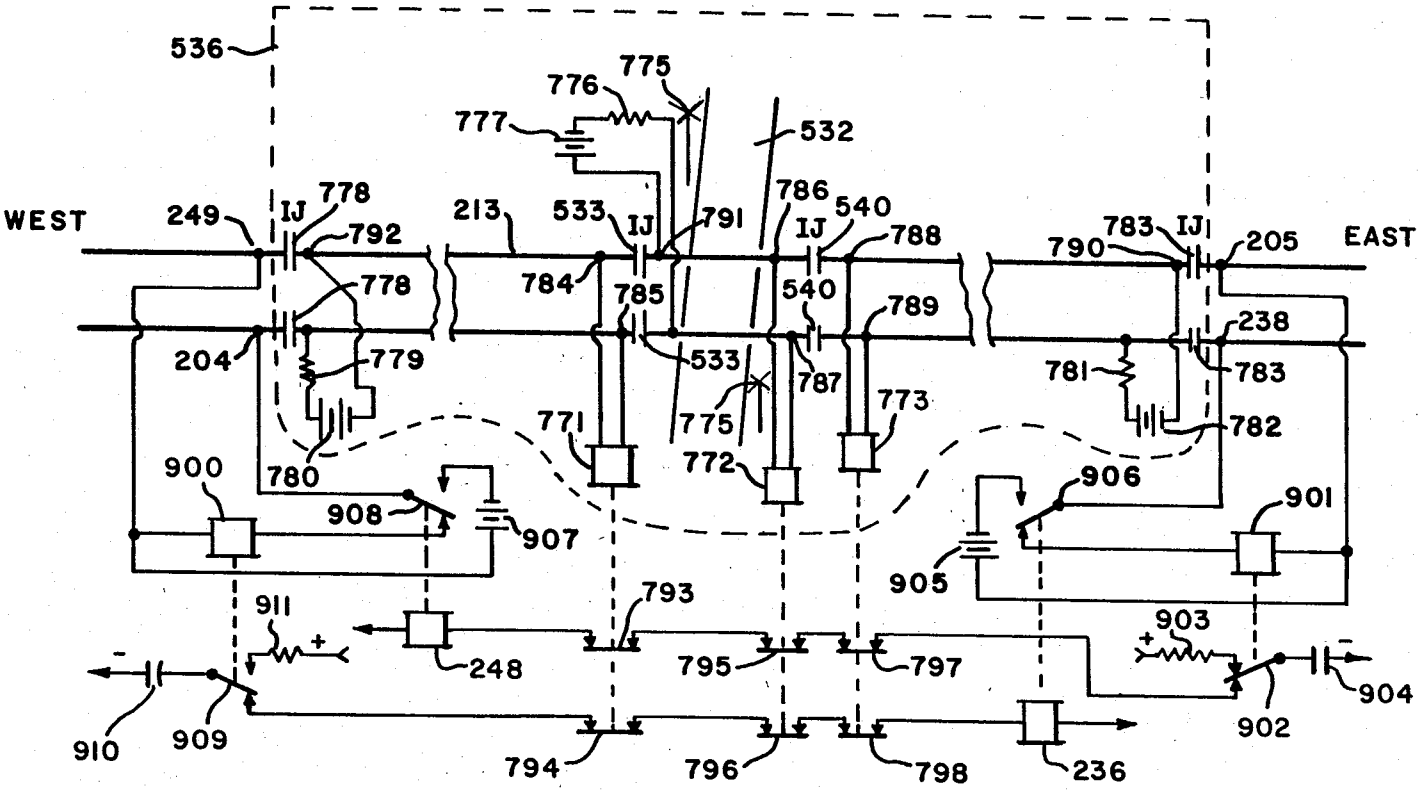
FIG. 9 is a diagram that illustrates the use of highway crossing protection equipment with the detection system shown in FIG. 7A–7D.

FIG. 9 illustrates the use of highway crossing protection equipment 536 that may be used with the bi-directional signal flow broken rail detection system shown in FIGS. 7A–7D. Equipment 536 comprises insulating joint pairs 778, 533, 540 and 783, resistors 776, 779 and 781, batteries 777, 780 and 782, relays 771, 772 and 773, and light signals and/or gate 775. Thus, FIG. 9 shows highway 532 crossing track 213 in Sections d–e of FIG. 7B (with some elements of FIG. 7B deleted) with insulating joint pairs 540 being connected to track 213 on one side of highway 532 and insulating joint pairs 533 being connected to track 213 on the other side of highway 532. Relay 771 is connected to track 213 at points 784 and 785 and relay 772 is connected to track 213 at points 786 and 787. Relay 773 is connected to track 213 at points 788 and 789. One end of resistor 781 is coupled to track 213 and the other end of resistor 281 is coupled to one of the terminals of battery 782. The other terminal of battery 782 is coupled to track 213 at point 790. One end of resistor 776 is coupled to track 213 and the other end of resistor 776 is coupled to one of the terminals of battery 777. The other terminal of battery 777 is coupled to track 213 at point 791. Resistor 779 has two ends. One end of resistor 779 is connected to track 213 and the other end of resistor 779 is connected to one of the two terminals of battery 780. The second terminal of battery 780 is connected to track 213 at point 792. Insulating joint pairs 778 are connected to track 213 to the left of point 792 and insulating joint pairs 783 are connected to track 213 to the right of point 790. One gate or light signal 775 is located on one side of track 213 adjacent highway 532 and the other gate or light signal 775 is located on the other side of track 213 adjacent highway 532. Equipment 536 is commercially available.

West approach relay 771 is coupled to contacts 793 and 794 and island relay 772 is coupled to contacts 795 and 796. East approach relay 773 is coupled to contacts 797 and 798. Contact 793 is connected to contact 795 and contact 795 is connected to contact 797. contact 794 is connected to contact 796 and contact 796 is connected to contact 798.

In order to avoid cluttering the drawing and to make this circuit easier to understand, certain elements appearing in FIGS. 7A–7D have been deleted. Thus, eastbound check relay 233 and 234 are shown as relay 900 with the elements connecting relays 233 and 234 to track 213 at points 249 and 204 simplified; westbound check relay 245 and 246 are shown in relay 901 with the elements connecting relays 245 and 246 to track 213 at points 203 and 238 simplified, and the elements associated with westbound feed relay 248 and eastbound feed relay 236 simplified.

Contact 793 is connected to westbound feed relay 248 and contact 797 is connected to back contact 902. Front contact 902 is coupled to one end of resistor 903 and the other end of resistor 903 is connected to a positive power source. The heel of contact 902 is connected to one end of capacitor 904 and the other end of capacitor 904 is connected to a negative power source. Relay 901 is connected to points 203 and 238 via battery 905 and contact 906, and relay 900 is coupled to points 204 and 249 via battery 907 and contact 908. Contact 794 is coupled to back contact 909. One end of resistor 911 is connected to front contact 909 and the other end of resistor 911 is connected to a positive power source. The heel of contact 909 is connected to one end of capacitor 910 and the other end of capacitor 910 is connected to a negative power source. Relay 900 is coupled to contact 909 and relay 248 is coupled to contact 908. Relay 901 is coupled to contact 902 and relay 236 is coupled to contact 906.

For purposes of illustration, we will assume that a rail break check is being performed and that a pulse is travelling along track 213 from west to east. If up to this point there is no rail break on track 213, the aforementioned pulse will pick up eastbound check relay 900. When relay 900 is picked up, capacitor 910 will be charged and at the end of the pulse, relay 900 will drop out and capacitor 910 will be discharged and eastbound feed relay 236 will be picked up. Eastbound feed relay 236 will connect battery 905 to track 213 and create another pulse which will be sent along track 213.

When highway crossing protection equipment is used in the circuit illustrated in FIG. 9 the broken rail detection system essentially leapfrogs around highway crossing protection equipment 536. Thus, the highway crossing protection equipment 536 provides the train detection function for the highway crossing as well as the broken rail detection function for the broken rail detection system. Hence, equipment 536 continues the propagation of the broken rail detection system signal pulse if there is no rail break between insulated joints 778 and 783.

It would be readily appreciated that equipment 536 may also be connected to the broken rail detection system shown in FIG. 5.

Figure 10:
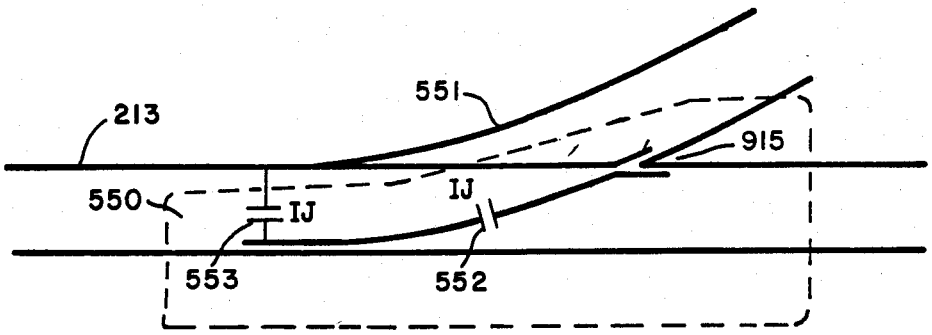
FIG. 10 is a diagram that illustrates the manner in which a simple track switch 550 is connected to the system shown in FIG. 7A–7D.

FIG. 10 illustrates the manner in which a simple track switch 550 may be connected to the broken rail detection system shown in FIGS. 7A–7D to permit the signal generated in the aforementioned system to pass through the tracks. Track 551 may be connected to track 213 by switch 550. Switch 550 comprises: insulating joints 553 and 552 and frog 915. The foregoing arrangement allows the rail break detection system described in FIGS. 7A–7D to operate and have switch 550 be transparent. The above embodiment provides no switch reverse protection or switch fouling protection. Switch 550 is insulated to prevent the track from being shorted out. Switch 550 may also be utilized with the embodiment described in FIG. 5.

Figure 11:
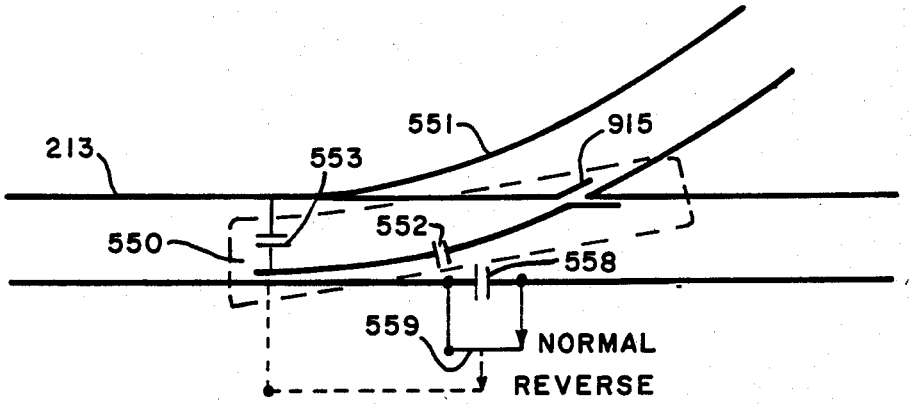
FIG. 11 is a diagram that illustrates an alternate embodiment of this invention in which a switch controller 559 and an insulated joint 558 are added to the structure of FIG. 10 to provide switch reverse protection.

FIG. 11 illustrates an alternate embodiment of this invention in which a switch controller 559 and an insulated joint 558 are added to the structure of FIG. 10 to provide switch reverse protection. Insulated joint 558 is connected to track 213 and a switch circuit controller is shunted around joint 558. Track 551 is connected to track 213 by switch 550. If switch 550 (insulating joints 552 and 553 and front 915) is in the normal position controller 559 has its contact closed and controller 559 will short out insulated joint 558, which functions as a pseudo rail break. If switch 550 is reversed, controller 559 has its contact open and insulated joint 558 that controller 559 shunts around provides a pseudo rail break which the bi-directional broken rail detection system shown in FIGS. 7A–7D will indicate as a rail break, thus providing reverse switch protection.

Figure 12:
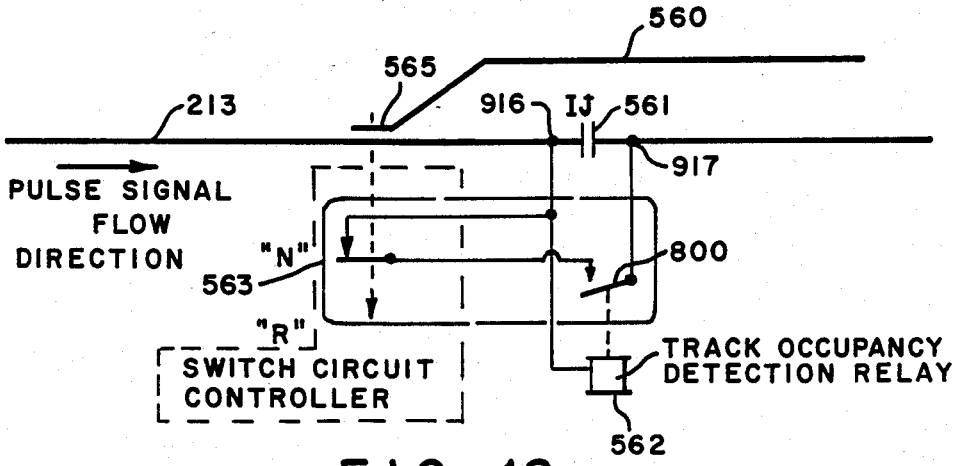
FIG. 12 is a diagram that illustrates an alternate embodiment of this invention that provides switch fouling protection and switch reverse detection for the system described in FIG. 5.

FIG. 12 illustrates an alternate embodiment of this invention that provides switch fouling protection (a system that would indicate when a railroad car located on a siding accidently rolled into the main line section of track and fouled the track) and switch reverse detection for the single direction broken rail detection system described in FIG. 5. This embodiment may only be used when the location of the switch is in the first third of the track section length. Siding 560 runs next to track 13, and insulated joint 561 is connected to track 13. Switch circuit controller 563 is connected to track 13 at point 916 and to front contact 800. The heel of contact 800 is connected to track 13 at point 917. Track occupancy detection relay 562 is bridged across track 13 just on the upstream side of joint 561. Switch circuit controller 563 is coupled to switch 565. Relay 562 has a relatively high impedance, which causes minimum loading on track 13 and provides high shunting sensitivity. If there is no train or car in the switch fouling area, track relay 562, at the switch will pick up when the broken rail detection pulse is present on track 13. The picking up of track relay 562 closes contact 800 which shorts out insulated joint 561 if switch controller 563 indicates switch 565 is in its normal position, which passes on the broken rail detection signal pulse to the next cut section repeater 15. The aforementioned signal pulse is sufficiently long to both pick up track relay 562 and then be passed on to break check relay 33 and 34 at the next cut section repeater 15. Track relay 562 has a low drop away value, hence relay 562 will not normally drop when insulated joint 561 is bi-passed, adding an additional load on to track 13 which may reduce the amplitude of the broken rail detection signal pulse.

Figure 13:
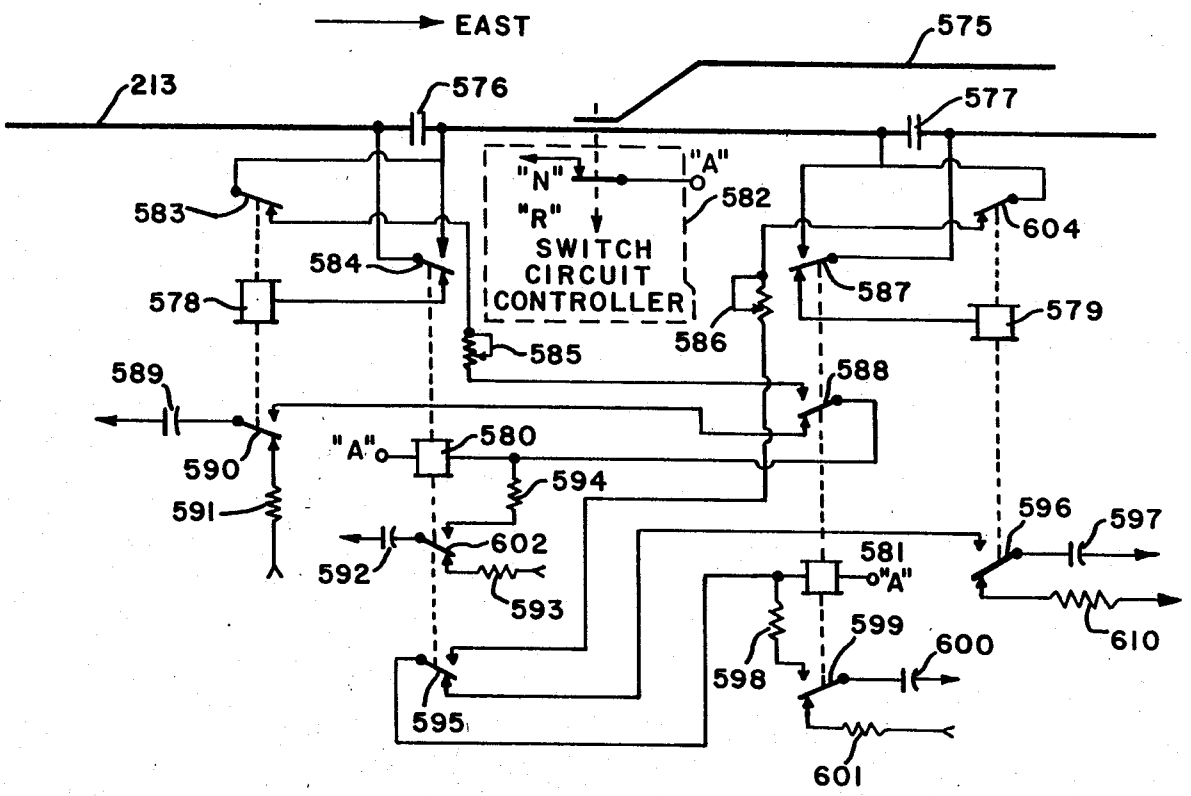
FIG. 13 is a diagram that illustrates an alternate embodiment of this invention that provides switch fouling protection and switch reverse detection for the system described in FIGS. 7A–7D.

FIG. 13 illustrates an alternate embodiment of this invention that provides switch fouling protection and switch reverse protection capabilities for the bi-directional broken rail detection system shown in FIGS. 7A–7D. This embodiment must be located no closer than one third of the maximum track section length from either the upstream or downstream repeater 215 (FIG. 7B) (not shown). Siding 575 is next to track 213 and insulated joints 576 and 577 are connected to track 213. Switch controller circuit 582 is coupled to track 213 and siding 575. Eastbound check relay 578 is coupled to back contact 584 and the heel of contact 584 is connected to track 213 outside the fouling boundary of joint 576. Front contact 584 is coupled to the heel of contact 583 and track 213, inside the fouling boundary of joint 576. Back contact 583 is coupled to one end of variable end resistor 585. The other end of resistor 585 is connected to front contact 588. The heel of contact 588 is coupled to relay 580 and one end of resistor 594. The other end of resistor 594 is connected to front contact 602. Back contact 602 is connected to one end of resistor 593 and the other end of resistor 593 is connected to a positive power source. The heel of contact 602 is coupled to one end of capacitor 592 and the other end of capacitor 592 is coupled to a negative power source. Relay 580 is also connected to switch controller 582. Back contact 588 is connected to front contact 590. The heel of contact 590 is connected to one end of capacitor 589 and the other end of capacitor 589 is connected to a negative power source. Back contact 590 is connected to one end of resistor 591 and the other end of resistor 591 is connected to a positive power source. Westbound break check relay 579 is connected to back contact 587 and front contact 587 is connected to track 213 inside the fouling boundary of joint 577. Front contact 587 is also connected to the heel of contact 604. Back contact 604 is connected to one end of variable resistor 586 and the other end of resistor 586 is connected to front contact 595. Back contact 595 is connected to front contact 596. The heel of contact 596 is coupled to one end of capacitor 597 and the other end of capacitor 597 is coupled to a negative power source. Back contact 596 is connected to one end of resistor 610 and the other end of resistor 610 is connected to a positive power source. The heel of contact 595 is connected to one end of resistor 598 and the other end of resistor 598 is connected to front contact 599. The heel of contact 599 is connected to one end of capacitor 600 and the other end of capacitor 600 is connected to a negative power source. Back contact 599 is coupled to one end of resistor 601 and the other end of resistor 601 is connected to a positive power source. The heel of contact 595 is also connected to one terminal of relay 581 and relay 581 is also connected to switch controller 582. Relay 578 is coupled to contact 583, and contact 590 and relay 579 is coupled to contact 604 and contact 596. Relay 581 is coupled to contacts 587, 588 and 599 and relay 580 is coupled to contacts 584, 602 and 595.

In order to illustrate the operation of this embodiment we will assume that the eastbound signal pulse arrives at the left side of insulated joint 576. If there is no broken rail up to this point, the aforementioned signal pulse will travel through contact 584 and cause relay 578 to pick up. The picking up of relay 587 will connect charged capacitor 589 to repeater relay 580 and pick it up. The pickup of relay 580 causes capacitor 592 to hold up relay 580. Relay 580 will disconnect relay 578 and short out insulated joint 576. Relay 580 also causes relay 581 to be connected to resistor 586 and resistor 586 will be connected to track 213 at a point which is to the right of joint 576 and in the switch fouling track circuit. The relatively high resistance of relay 581 now acts as the switch fouling track circuit track relay. If there are no cars shunting the switch fouling track circuit, relay 581 will pick and stick itself up on charge capacitor 600. Relay 581 will also cause relay 579 to be disconnected from track 213 and short out insulated joint 577 so that the broken rail detection signal poles can pass through to the next cut repeater section 215 (not shown). If there are cars in the switch fouling zone either relay 580 or relay 581 or both will not pick up and insulated joints 576 and 577 will not be bypassed, so the broken rail detection signal pulse will not be passed through this embodiment, indicating a pseudo broken rail track condition.

The above specification describes a new and improved broken rail detection system that may be used to detect broken rails in dark territory. It is realized that the above description may indicate to those skilled in the art additional ways in which the principals of this invention may be used without departing from its spirit. It is therefore intended that this invention be limited only by the scope of the appended claims.

What is claimed is:

1. A system for detecting a break in a track section having a pair of rails disposed on earth ground and when said rails have rail joints in said rail joints, said track section having a feed end and a receive end and insulated joints at the feed end and at the receive end of said track section, said system comprising:

a. means for initiating a break check such that when said check is begun a source of electrical power is connected across the feed end of said track;

b. a first detection relay having a first coil and a second coil;

c. a second detection relay having a third coil and a fourth coil, said first coil, and said third coil being connected in series and connected across the receive end of said track in order to sense the voltage between the rails of said track, and said second coil and said fourth coil being connected in series to said earth ground in order to sense the presence of an unbalanced ground current; and d. means for displaying a break, said displaying means being coupled to said first and second relay so that, when said track does not have a break, there is no unbalanced current flowing through earth ground causing said displaying means to indicate that there is no break and when there is a break the current flows through said first and second relays to earth ground causing said display means to indicate that there is a break.

2. The system claimed in claim 1 wherein a first and second rail comprise said pair of rails and said initiating means comprises:

a. a source of electrical power that is coupled to the first rail of said track; and b. contacting means that is coupled to said power source and the second rail of said track for providing source resistance of 0.1 ohms or less, between said source and said rails.

3. The system claimed in claim 2 wherein said contacting means is an electronic switching element.

4. The system claimed in claim 2 wherein said contacting means is a mechanical switching element.

5. The system claimed in claim 2 wherein said electrical power source is a battery.

6. The system claimed in claim 1 wherein said first and second relays have a resistance of 0.1 ohms or less as measured between the rails of said pair of rails.

7. The system claimed in claim 1 wherein said displaying means comprises:

a. a first contact that is coupled to said second relay;

b. a second contact that is coupled to said first relay and said first contact;

c. an energy source coupled to said contact, means for indicating a break, said indicating means being coupled to said first and second contacts whereby if there is a break one of said first contact and said second contact will be open, and if there is no break both said first and second contacts will be closed.

8. The system claimed in claim 7 wherein said energy source is a battery.

9. The system claimed in claim 7 wherein said means for indicating is wayside equipment.

10. The system claimed in claim 9 wherein said wayside equipment is signal lights.

11. The system claimed in claim 7 wherein said means for indicating is a computer.

12. The system claimed in claim 7 wherein said means for indicating is a panel board indicator.

13. The system claimed in claim 1 wherein a plurality of said first and second relays are coupled to said track in a cascading manner.

14. A broken rail detection system that detects breaks in rails lying on an earth ground and, when said rails are connected by rail joints, in the rail joints of a track section, said track section having insulating joints at a receive end of said track section and insulating joints at a feed end of said track section which are at opposite ends of said section, said system also having a source of electrical power which system comprises:

a. means for initiating a break check and then connecting said source of electrical power across said rails at the feed end of said track to transmit current along said rails;

b. detection relay means coupled to said track across said rails and responsive to the current flowing between said rails and from any one of said rails to said ground by detecting an unbalanced ground current, whether or not a train is present on said track section; and c. means for displaying a break, said displaying means having means coupled to said detection relay means so that, when said track does not have a break said current is sufficient to energize said detection relay means and when there is a break said current is insufficient to energize said detection relay means.

15. The system claimed in claim 14 wherein said rails consists of a first rail and a second rail and a. said source of electrical power being coupled to said first rail of said track; and b. contacting means coupled to said power source and the second rail of said track and presenting a resistance of 0.1 ohms or less across said rails.

16. The system claimed in claim 15 wherein said contacting means is an electronic switching element.

17. The system claimed in claim 15 wherein said contacting means is a mechanical switching element.

18. The system claimed in claim 15 wherein said electrical power source is a battery.

19. The system as claimed in claim 14 wherein said relay means has a resistance of 0.1 ohms or less as measured between said rails.

20. The system claimed in claim 14 wherein said displaying means comprises:

a. a contact that is coupled to said relay means which is closed when said relay means is energized;

b. an energy source coupled to said contact, means for indicating a break, said indicating means being coupled to said contact and connected via said contact to said energy source whereby if there is a break said contact will be open and said indicating means is operative to indicate said break, and if there is no break said contact will be closed and said indicating means is operative to indicate the absence of said break.

21. The system claimed in claim 20 wherein said energy source is a battery.

22. The system claimed in claim 20 wherein said means for indicating is wayside equipment.

23. The system claimed in claim 22 wherein said wayside equipment is signal lights.

24. The system claimed in claim 20 wherein said means for indicating is a computer.

25. The system claimed in claim 20 wherein said means for indicating is a panelboard indicator.

26. A broken rail detection system that detects breaks in the rails, and if equipped with joints between successive lengths of rail the rail joints, of a track section that has a communications link between the ends of said track section, said rails being disposed along the ground, said system comprising:

a. means connected across the rails at at least one end of said track section for initiating a break check by generating a track current signal which propagates along said rails to the other end of said section;

c. first and second relays each having a pair of operating windings wound in a sense to change the condition of said relays from make to break when current passes in the same direction therethrough, both said pair of windings of said first relay and one of said pair of windings of said second relay being connected across said rails at the other end of said section, and one of said pair of windings of said first relay and the other of said pair of windings of said second relay being connected between one of said rails and said ground;

d. means coupled to said first and second relays and responsive to the condition of said relays and also coupled to said communications link for communicating along said communications link information representing the presence of said signal and whether a break is present in said section of track.

27. The system as claimed in claim 26 further including wayside equipment that is coupled to said first and second relays, said wayside equipment having means for indicating whether or not a break is present in said track section.

28. The system claimed in claim 27 wherein said wayside equipment is signal lights.

29. The system claimed in claim 26 wherein a roadway having highway crossing protection equipment crosses said track section, insulating joints in the rails of said track section on the sides of said rails which approach said crossing from opposite directions and define the approach end of said crossings, and means included in said highway crossing protection equipment for providing a path for said signal bridging said approach ends.

30. The system claimed in claim 26 further including an insulating joint that is connected to a track siding which insulates said siding from the rails of said track section, and means for bypassing said signal around said joints so that said siding is transparent to said signal.

31. The system claimed in claim 26 further including an insulated joint connected to a track siding that has a switch controller, which joint insulates said siding from the rails of said track section, and means for bypassing said signal around said joint operated by said switch controller.

32. The system as claimed in 31 wherein said bypassing means includes a relay that is connected across said insulating joint and said switch controller has switch means that is connected across said joint to control said relay for providing fouling and switch reverse detection protection.

33. The system claimed in claim 26 wherein said initiating means comprises a first relay and means for energizing said relay.

34. The system as claimed in claim 33 wherein said initiating means comprises:

a. a first switch operated by said first relay;
b. a source of electric power;
c. a second switch that is coupled to said power source and said track for applying a pulse as said signal to said track; and
d. a second relay that is coupled to said first switch for operating said second switch for a specified period of time causing said electric power source to be coupled to said track to generate said track current signal pulse.

35. The system claimed in claim 34 wherein said source of electric power is a battery.

36. The system claimed in claim 35 further including means coupled to said battery for charging said battery.

37. The system as claimed in claim 26 wherein at least one repeater is coupled to said track for transmitting said current pulse signal.

38. The system claimed in claim 37 wherein said repeater comprises:

a. a first means for switching said current signal, said switching means being coupled to said track;
b. a first means for relaying said current signal, said relaying means being coupled to said first switching means; and
c. a source of electric power that is coupled to said switching means and said track.

39. The system claimed in claim 26 wherein another track may be connected to said track and track crossing means are included for passing said signal from said track switch to said receiving means.

40. The system claimed in claim 39 wherein said crossing means comprises:

a. a frog that is connected to the first rail of said another track;
b. a first insulating joint that is connected across said another track; and
c. a second insulating joint that is connected to the first rail of said another track to prevent said frog from shorting said track.

41. A broken rail detection system that detects breaks in a rail, and if said rail has rail joints in the rail joints, in a track section, said system comprising:

a. means for initiating a break check;
b. means coupled to said initiating means for generating a track current signal;
c. means coupled to said generating means for transmitting said signal through the rails of said track section;
d. means coupled to said track section for receiving said signal;
e. means coupled to said receiving means for communicating the reception of such signal whereby if said signal is received by said receiving means no breaks are detected in said track section and if said signal is not received by said receiving means a break is detected in said track section;

highway crossing means for passing said signal past a highway intersection with said track section; said highway crossing means comprising:

a. a first insulating joint pair that is connected to said track near one side of the highway; said highway insulating joint pair
b. a second insulating point pair that is connected to said track near the opposite side of the highway;
c. a first relay that senses said signal, said first relay being connected to said track near the connection of said first joint pair so that said first relay will not be between said first joint pair and the highway;
d. a second relay that senses said signal, said second relay being connected to said track at the intersection of said track and highway;
e. third relay that senses said signal, said third relay being connected to said track near the connection of said second joint pair so that said second joint pair will not be between said second joint pair and the highway; and
f. means coupled to said first, second and third relays and said transmitting means for forwarding said signal.

42. The system claimed in claim 41 wherein said forwarding means comprises:

a. a first contact that transmits said signal to said transmitting means said first contact is coupled to said first relay and said transmitting means;
b. a second contact that transmits said signal to said transmitting means said second contact is coupled to said second relay and said transmitting means; and
c. a third contact that transmits said signal to said transmitting means said third contact is coupled to said third relay and said generating means;

43. A broken rail detection system that detects breaks in a rail, and if said rail has a rail joints in the rail joints, in a track section, said system comprising:

a. means for initiating a break check;
b. means coupled to said initiating means for generating a track current signal;

c. means coupled to said generating means for transmitting said signal through the rails of said track section;

d. means coupled to said track section for receiving said signal;

e. means coupled to said receiving means for communicating the reception of such signal whereby if said signal is received by said receiving means no breaks are detected in said track section and if said signal is not received by said receiving means a break is detected in said track section;

wherein another track is disposed across said track and track crossing means are included for passing said signal across said another track, said crossing means comprising:

a. a frog that is connected to the first rail of said another track;

b. a first insulating joint that is connected across said another track; and c. a second insulating joint that is connected to the first rail of said another track to prevent said frog from shorting said track; and further including an insulating joint connected to one of the rails of said track in the vicinity of said frog, and a switch controller that is shunted around said insulating joint so that when said switch controller is in the reverse position, said controller will open circuit said joint in order to function as a pseudo rail break to provide reverse switch protection.

44. A broken rail detection system that detects breaks in a rail and if said rail has rail joints in the rail joints in a track section, said system comprising:

a. means for initiating a break check;

b. means coupled to said initiating means for generating a track current signal;

c. means coupled to said generating means for transmitting said signal through the rails of said track section;

d. means coupled to said track section for receiving said signal;

e. means coupled to said receiving means for communicating the reception of such signal whereby if said signal is received by said receiving means no breaks are detected in said track section and if said signal is not received by said receiving means a break is detected in said track section;

wherein a siding is disposed next to said track section and switch fouling protection means coupled to said siding and said track for initiating a pseudo rail break if a rail car located on said siding accidentally rolls onto said track, and wherein said fouling means comprises:

a. a first insulating joint pair that is connected to said track near one side of the intersection of said siding and said track;

b. a second insulating joint pair that is connected to said track near the opposite side of the intersection of said siding and said track;

c. a switch controller that is coupled to said track and said siding; and d. relay means coupled to said first and second insulating joint pair and said controller whereby if a car is in the switch fouling zone said relay means will not be picked up and said first and second insulating joints will not be bypassed preventing passing said signal.

* * * * *